US009874349B2

(12) United States Patent
Frenette et al.

(10) Patent No.: US 9,874,349 B2
(45) Date of Patent: Jan. 23, 2018

(54) FUEL COMBUSTION SYSTEM

(71) Applicants: Eugene R. Frenette, Salisbury, NH (US); Henry E. Frenette, Pittsfield, NH (US)

(72) Inventors: Eugene R. Frenette, Salisbury, NH (US); Henry E. Frenette, Pittsfield, NH (US)

( * ) Notice: Subject to any disclaimer, the term of this patent is extended or adjusted under 35 U.S.C. 154(b) by 336 days.

(21) Appl. No.: 14/683,641

(22) Filed: Apr. 10, 2015

(65) Prior Publication Data

US 2016/0290635 A1 Oct. 6, 2016

Related U.S. Application Data

(60) Provisional application No. 62/142,714, filed on Apr. 3, 2015.

(51) Int. Cl.
*F23D 14/24* (2006.01)
*F23D 14/56* (2006.01)
(Continued)

(52) U.S. Cl.
CPC ..... *F23D 14/24* (2013.01); *F23D 11/106* (2013.01); *F23D 11/404* (2013.01);
(Continued)

(58) Field of Classification Search
CPC ..... F23D 1/00; F23D 11/408
(Continued)

(56) References Cited

U.S. PATENT DOCUMENTS 339,177 A 4/1886 Herlehy et al.
349,211 A 9/1886 Cottrell
(Continued)

FOREIGN PATENT DOCUMENTS

EP 0 253 324 A2 1/1988
JP 60002827 A 1/1985
(Continued)

OTHER PUBLICATIONS

International Search Report Corresponding to PCT/US2015/024492 dated Aug. 2, 2015.
(Continued)

*Primary Examiner* — Avinash Savani
(74) *Attorney, Agent, or Firm* — Davis & Bujold PLLC; Michael J. Bujold

(57) ABSTRACT

A combustion system comprises a discharge nozzle with concentric air and fuel orifices. A fuel conduit is coupled to each fuel orifice while an air conduit is coupled to each air orifice. The fuel and air only mixing with one another upon discharge. A supplemental air source supplies supplement air for combustion. An air deflector disk supports the discharge nozzle and a cylindrical blast tube surrounds the air deflector sleeve and the air deflector disk while an outlet end of the cylindrical blast tube supports a flame retention head. The deflector disk permits some combustion air to flow into the combustion chamber while redirecting a remaining portion of the supplement air. The flame retention head permits some of the supplement air to discharge into a burner box while redirecting the remaining supplement air radially inward through openings in the air deflector sleeve to assist with combustion of the fuel mixture.

20 Claims, 19 Drawing Sheets

(51) Int. Cl.

| | |
|---|---|
| ***F23D 14/58*** | (2006.01) |
| ***F23D 23/00*** | (2006.01) |
| ***F23D 11/10*** | (2006.01) |
| ***F23D 11/40*** | (2006.01) |

(52) U.S. Cl.
CPC ..... *F23D 11/408* (2013.01); *F23D 14/56* (2013.01); *F23D 14/58* (2013.01); *F23D 23/00* (2013.01); *F23D 2203/1012* (2013.01); *F23D 2207/00* (2013.01); *F23D 2900/11101* (2013.01)

(58) Field of Classification Search
USPC ..... 431/9
See application file for complete search history.

(56) References Cited

U.S. PATENT DOCUMENTS

| | | | | |
|---|---|---|---|---|
| 654,378 | A | | 7/1900 | Barckdall |
| 710,130 | A | | 9/1902 | Weiss |
| 903,786 | A | | 11/1908 | Rutherford |
| 1,169,091 | A | | 1/1916 | Melas |
| 1,330,048 | A | | 2/1920 | Baker |
| 1,446,514 | A | | 2/1923 | Norris |
| 1,451,063 | A | | 4/1923 | Anthony |
| 1,460,130 | A | | 6/1923 | Hofmann |
| 1,554,362 | A | | 9/1925 | Metcalfe |
| 1,605,251 | A | | 11/1926 | MacMillan et al. |
| 1,747,094 | A | | 2/1930 | Whikehart |
| 1,858,526 | A | | 5/1932 | Schwarzkopf |
| 1,878,467 | A | | 9/1932 | Clarke |
| 1,883,142 | A | | 10/1932 | Wannack |
| 1,916,577 | A | | 7/1933 | Lorimer |
| 2,022,513 | A | | 11/1935 | Macchi |
| 2,050,117 | A | | 8/1936 | Page |
| 2,070,209 | A | | 2/1937 | Kerr |
| 2,079,586 | A | | 5/1937 | Atwell |
| 2,121,271 | A | | 6/1938 | Szabo |
| 2,145,874 | A | | 2/1939 | Hermsdorf |
| 2,157,265 | A | | 5/1939 | Pothier et al. |
| 2,254,123 | A | | 8/1941 | Soaper |
| 2,719,584 | A | | 10/1955 | Winslow |
| 2,764,455 | A | | 9/1956 | Seibel |
| 2,796,118 | A | | 6/1957 | Parker et al. |
| 2,815,069 | A | | 12/1957 | Garraway |
| 2,873,099 | A | | 2/1959 | Wittke |
| RE24,771 | E | | 1/1960 | Seibel |
| 3,039,701 | A | | 6/1962 | Carlisle |
| 3,070,317 | A | | 12/1962 | Hunter et al. |
| 3,091,283 | A | | 5/1963 | Kidwell |
| 3,245,457 | A | | 4/1966 | Smith et al. |
| 3,246,851 | A | | 4/1966 | Biber et al. |
| 3,260,299 | A | | 7/1966 | Lister |
| 3,596,673 | A | | 8/1971 | Laucournet |
| 3,662,960 | A | | 5/1972 | Mitchell et al. |
| 3,720,496 | A | | 3/1973 | Briggs |
| 3,759,286 | A | | 9/1973 | Page |
| 3,864,577 | A | | 2/1975 | Pellett et al. |
| 3,924,648 | A | | 12/1975 | Etter |
| 3,925,033 | A | | 12/1975 | Mayo |
| 3,946,552 | A | | 3/1976 | Weinstein et al. |
| 3,963,182 | A | | 6/1976 | Rulseh |
| 3,989,477 | A | | 11/1976 | Wilson et al. |
| 4,099,488 | A | | 7/1978 | Damon |
| 4,105,163 | A | | 8/1978 | Davis, Jr. et al. |
| 4,113,425 | A | | 9/1978 | von Linde et al. |
| 4,125,360 | A | | 11/1978 | Culbertson |
| 4,230,449 | A | | 10/1980 | Binasik et al. |
| 4,232,832 | A | | 11/1980 | De Fusco |
| 4,278,412 | A | | 7/1981 | Ozaki et al. |
| 4,278,418 | A | | 7/1981 | Strenkert |
| 4,295,816 | A | | 10/1981 | Robinson |
| 4,362,022 | A | | 12/1982 | Faucher et al. |
| 4,426,984 | A | | 1/1984 | Gilbert |
| 4,464,314 | A | | 8/1984 | Surovikin et al. |
| 4,466,250 | A | | 8/1984 | Mukaeda |
| 4,509,915 | A | | 4/1985 | Ito |
| 4,598,742 | A | | 7/1986 | Taylor |
| 4,606,720 | A | * | 8/1986 | Harvey ..... F23D 11/005 431/115 |
| 4,717,332 | A | | 1/1988 | Edens |
| 4,753,593 | A | * | 6/1988 | Mutchler ..... F23D 11/406 431/183 |
| 4,903,684 | A | | 2/1990 | Gruber et al. |
| 5,207,251 | A | | 5/1993 | Cooks |
| 5,344,311 | A | | 9/1994 | Black |
| 5,460,514 | A | | 10/1995 | Toyoshima et al. |
| 5,484,107 | A | | 1/1996 | Holmes |
| 5,507,326 | A | | 4/1996 | Cadman et al. |
| 5,749,978 | A | | 5/1998 | Colombani et al. |
| 5,769,058 | A | | 6/1998 | Scogin |
| 5,873,524 | A | | 2/1999 | Bodelin et al. |
| 5,921,470 | A | | 7/1999 | Kamath |
| 6,082,113 | A | | 7/2000 | Prociw et al. |
| 6,119,954 | A | | 9/2000 | Kamath |
| 6,193,874 | B1 | | 2/2001 | Chern |
| 6,247,317 | B1 | | 6/2001 | Kostka |
| 6,565,325 | B2 | | 5/2003 | Belehradek |
| 6,571,748 | B2 | | 6/2003 | Holder et al. |
| 6,622,664 | B2 | | 9/2003 | Holder et al. |
| 6,899,289 | B2 | | 5/2005 | McCracken et al. |
| 2009/0035709 | A1 | | 2/2009 | Mennie et al. |
| 2009/0075223 | A1 | * | 3/2009 | Mosiewicz ..... F23D 14/62 431/351 |
| 2010/0209858 | A1 | | 8/2010 | Frenette et al. |

FOREIGN PATENT DOCUMENTS

| | | | |
|---|---|---|---|
| JP | 01189419 | A | 7/1989 |
| JP | 11281015 | A | 10/1999 |
| WO | 2013/175466 | A1 | 11/2013 |

OTHER PUBLICATIONS

Written Opinion Corresponding to PCT/US2015/024492 dated Aug. 2, 2015.

Natural Resources Canada, Maximizing Efficiency in Forced-air Heating, http://oee.nrcan/gc/ca/residential/personal/maximizing-efficiency-forced-air.cfm?attr=4, May 6, 2009, 1-4.

Spirax Sarco, Boiler Efficiency and Combustion, http://www.spiraxsarco.com/resources/steam-engineering-tutorials/the-boiler-house/boiler-efficiency-and-combustion.asp, May 6, 2009, 1-8.

Integrated Publishing, Steam-Atomizing and Air-Atomizing Burners, http://tpub.com/content/construction/14279/css/14279_136.htm, May 6, 2009, 1-2.

* cited by examiner

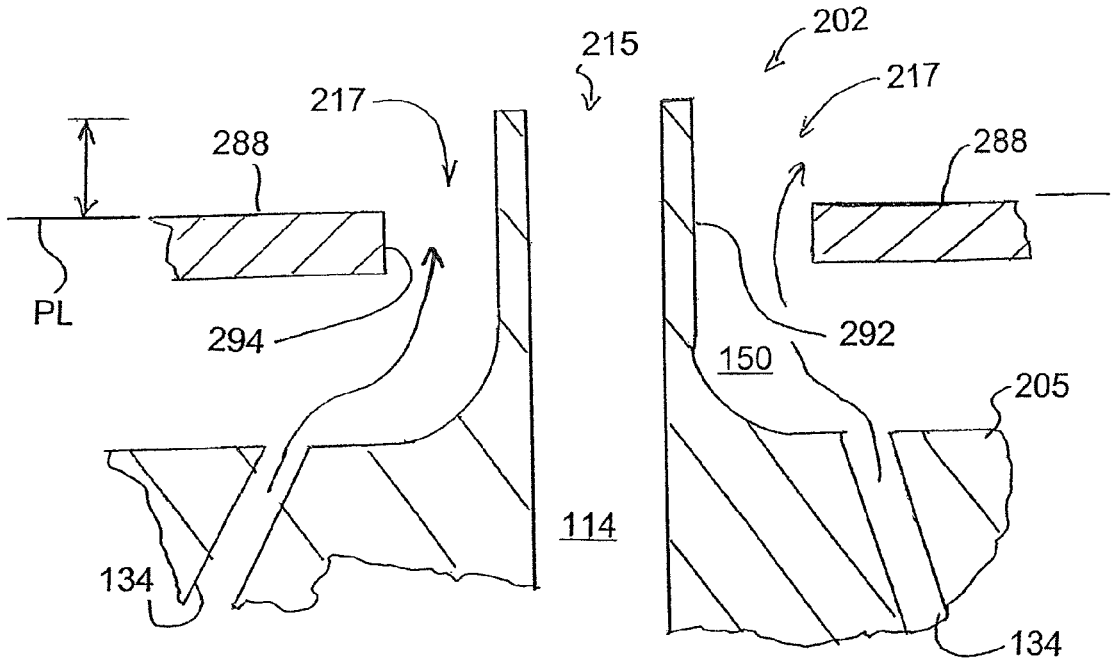
FIG. 6A
FIG. 8
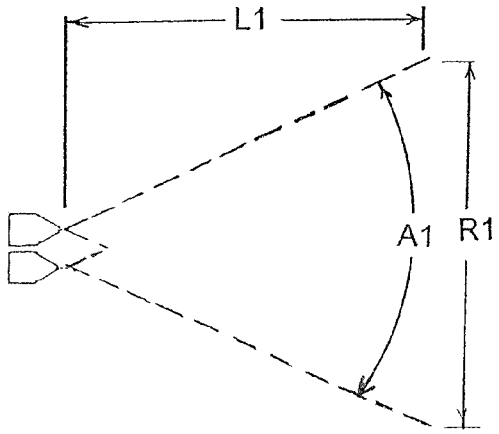

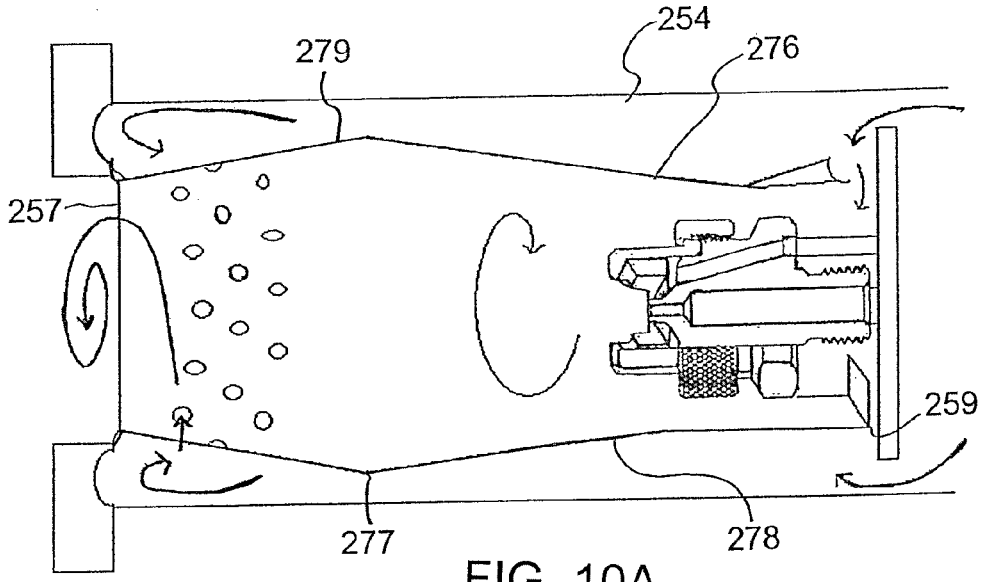
FIG. 10A
FIG. 10E
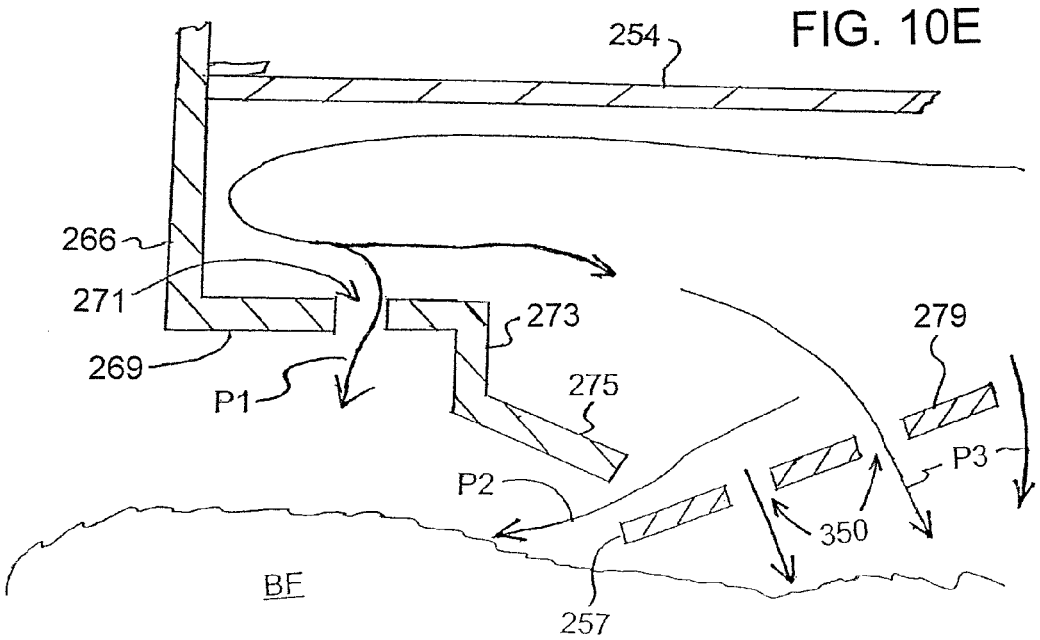

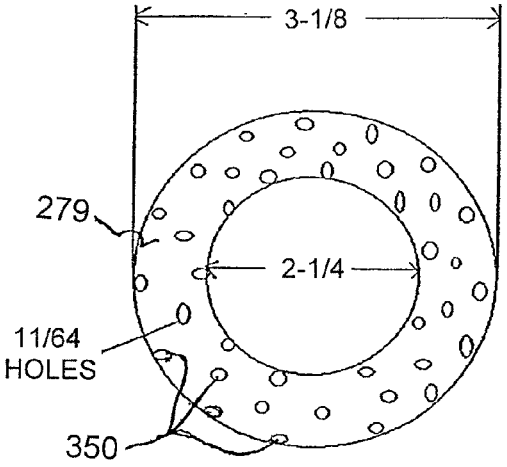
FIG. 10C
FIG. 10D
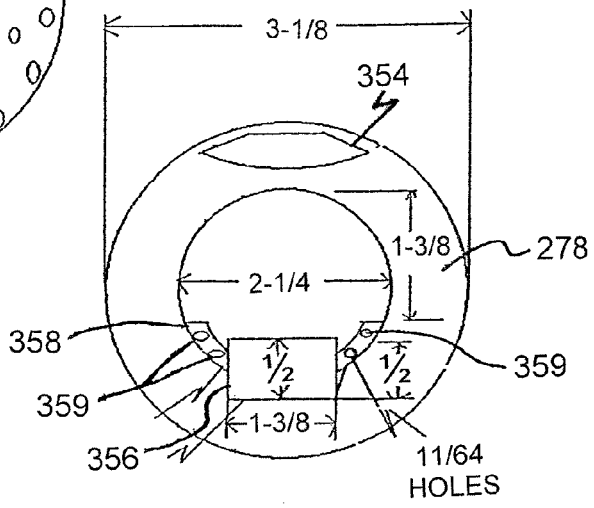
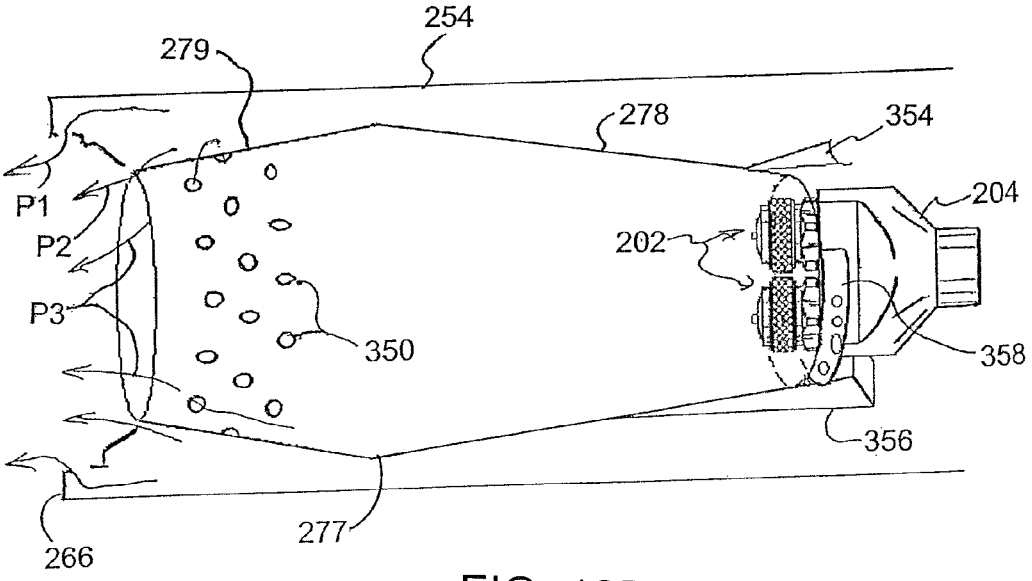
FIG. 10B

FUEL COMBUSTION SYSTEM

This application claims priority from U.S. provisional application No. 62/142,714 filed Apr. 3, 2015 which is a continuation-in-part of U.S. patent application Ser. No. 14/192,198 filed Feb. 27, 2014 which claims priority from U.S. provisional application No. 61/937,131 filed Feb. 7, 2014.

FIELD OF THE INVENTION

The present invention relates to an improved fuel source which is directed at achieving substantially "complete combustion" of the fuel source so that substantially all of the fuel source is converted into $CO_2$ and $H_2O$ without any significant amount of unburned hydrocarbons.

BACKGROUND OF THE INVENTION

As is well known in the art, the combustion of most fuels typically results from the combustion of fuel and air whereby the byproducts are typically unburned hydrocarbons, carbon dioxide, nitric oxides, carbon monoxide, and water. One of the drawbacks associated with such combustion is that the unburned hydrocarbons are normally vented and pollute the atmosphere. In addition, the combustion byproducts tend to leave the combustion chamber in a heated state, thus carrying heat away from the combustion region, thereby reducing the energy efficiency of the combustion system.

A few related known patents are U.S. Pat. Nos. 4,278,412; 5,344,311; 5,921,470; and 6,119,954. Specifically, U.S. Pat. No. 4,278,412 to Strenekert relates to a process and apparatus for combustion of liquid fuel which provides an extremely intense blue/violet flame. To achieve this, Strenekert discloses mixing the oil and the air with one another to form an oil/air mixture immediately prior to the oil and air mixture being injected from the nozzle.

U.S. Pat. No. 5,344,311 to Black relates to an oil burner having rotary air compressed in which the operating and capital expense, associated with the burner, are reduced by using a compressor which is lubricated with fuel oil supplied for the burner.

U.S. Pat. Nos. 5,921,470 and 6,119,954, both issued to Kamath, relates to a burner utilizing a low pressure fan for atomizing oil and supplying air for combustion. This patent discloses radially injecting the oil into the airstream and thereby mixing the oil with the air prior to the oil and the air exiting from the atomizing nozzle.

SUMMARY OF THE INVENTION

Wherefore, it is an object of the present invention to overcome the drawbacks associated with the prior art combustion of fuel so as to approach a substantially "perfect combustion" in which such fuel (i.e., fuels containing hydrocarbons) and the air are substantially completely reacted with one another to result in substantially only carbon dioxide ($CO_2$) and water ($H_2O$) and unaffected nitrogen ($N_2$).

An object of the present invention is to provide a burner which is relatively inexpensive to manufacture but which has an improved efficiency while still minimizing the generation of carbon dioxide ($CO_2$) during operation thereof.

A further object of the present invention is to atomize or vaporize substantially all of the fuel components and mix the vaporized fuel components with an adequate supply of air (e.g., oxygen) to thereby result in a complete and thorough combustion of all of the fuel components (i.e., hydrocarbons) so as to minimize the discharge of any pollutants (e.g., unburned hydrocarbons) which are exhausted to the atmosphere. Such complete combustion thereby increases the overall energy efficiency of the combustion system.

Yet another object of the present invention is to minimize the consumption of the fuel product, during combustion, and maximize utilization of the air to thereby result in a clean and more thorough combustion of the fuel components.

A still further object of the present invention is to combine two different fuels with one another, e.g., a gaseous fuel component such as compressed air, propane, natural gas, etc., and a liquid fuel component such as gasoline, kerosene, #2 home heating oil, diesel fuels such, as standard diesel fuel and bio-diesel, or some other petroleum or combustible product and form an atomized and/or a vaporized fuel mixture thereof which, when burned, results in the complete and thorough combustion of the atomized vaporized fuel mixture.

Yet another object of the invention is to provide a process and an apparatus in which the liquid fuel component is emitted from the nozzle separately from the air component so that the fuel and air components only mix with one another immediately upon entering the burner and thereby form a uniform combustion mixture which is substantially completely consumed upon combustion.

A still further object of the invention is to have the plurality of fuel component outlets centered with respect to air component outlet, and have the fuel component outlet extend a small distance further into the combustion boiler and have the air component assist with withdrawing and/or extracting the fuel component from the fuel component outlet and thereby form a uniform combustion mixture of minute particles which is substantially completely consumed upon combustion.

A further object of the present invention is to provide an improved burner, which comprises many conventional furnaces components but altering the manner in which the liquid fuel component and the pressurized air are discharged into the furnace to improve combustion and efficiency thereof.

A still further object of the present invention is to provide a discharge nozzle with at least two closely spaced generally concentric liquid fuel and air discharge orifices which are each supplied with a liquid fuel component and a pressurized air component so that the discharge nozzle discharges the liquid fuel component and the pressurized air component such that the fuel components intimately mix.

Yet another object of the present invention is to discharge the pressurized air component concentrically around the liquid fuel component so that the pressurized air component assists with withdrawing the liquid fuel component from the liquid fuel orifice and automatization of the liquid fuel component to a particle size of between about 30 microns and about 35 microns.

A further object of the present invention is to provide adequate control over the supply rate of the fuel component so as to minimize consumption of the liquid fuel component and also facilitate a substantially complete combustion of the fuel mixture.

Still another object of the present invention, is to provide an air compressor for supplying the pressurized air component and equip the air compressor with control features which control both the flow rate and the supply pressure of the compressed air and thereby facilitate complete combustion of the fuel mixture.

Another object of the present invention is to supply a small portion of the supplemental air directly to the furnace while diverting a major portion of the supplemental air and supplying the same to the discharged nozzles to facilitate both cooling of the discharged nozzles and combustion of the fuel mixture.

It is a further object of the present invention to provide a fuel combustion system in which the carbon dioxide ($CO_2$) content—contained in the exhaust fumes—is as high as possible, e.g., generally greater than 12 ppm and more preferably greater than 14 ppm, while the amount of carbon monoxide (CO)—contained in the flu gases—is as low as possible, e.g., approaching 0 ppm.

Yet another object of the present invention is to increase the temperature of the flame, within the furnace, so that the temperature of the flame is greater than 2,000° F., more preferably the temperature of the flame is greater than 2,220° F., and most preferably the temperature of the flame is greater than 2400° F. while the temperature of the exhaust gases, exhausting from the furnace, is below 400° F., and most preferably the temperature of the exhaust gases is below 350° F.

The present invention also relates to a fuel combustion system for burning a fuel mixture, the fuel combustion system comprising: at least one discharge nozzle being supported by a fuel discharge body, and each at least one discharge nozzle having a liquid fuel orifice and a concentric air orifice surrounding the liquid fuel orifice; a liquid fuel supply conduit being coupled to each liquid fuel orifice for supplying liquid fuel thereto from a fuel supply; an air supply conduit being coupled to each air orifice for supplying pressurized air thereto from a pressurized air source; the liquid fuel and the pressurized air only mixing with one another, to form the fuel mixture, upon being discharged from the concentric liquid fuel and air orifices; an inlet section of an air deflector sleeve being located for receiving the fuel mixture discharged by the at least one discharge nozzle; a blast tube surrounding the air deflector sleeve and an outlet end of the cylindrical blast tube supporting a flame retention head; a supplemental air fan for supplying supplement air into an inlet end of the blast tube for supplying supplement air to assist with combustion of the fuel mixture; an air deflector disk supporting the at least one discharge nozzle within the blast tube and directing some of the supplement air into the inlet section of the air deflector sleeve and redirecting a remaining portion of the supplement air toward the flame retention head, and the air deflector disk being located between the fuel discharge body and the inlet section of the air deflector sleeve; and the flame retention head discharging some of the supplemental air axially through plurality of plurality of apertures formed therein and redirecting a remaining portion of the supplement air radially inward through a plurality of openings formed in an outlet section of the air deflector sleeve to assist with combustion of the fuel mixture.

The present invention also relates to a method of supplying a fuel mixture to a fuel combustion system for burning the fuel mixture, the fuel combustion system comprises at least one discharge nozzle supported by a fuel discharge body, and each discharge nozzle has a centrally located liquid fuel orifice and a concentric air orifice surrounding the liquid fuel orifice; a liquid fuel supply conduit coupled to each liquid fuel orifice for supplying liquid fuel thereto from a fuel supply; an air supply conduit being coupled to each air orifice for supplying pressurized air thereto from a pressurized air source; the liquid fuel and the pressurized air only mixing with one another, to form the fuel mixture, upon discharge from the respective liquid fuel and air orifices; an inlet section of an air deflector sleeve is axially spaced from the at least one discharge nozzle for receiving the fuel mixture discharged by the at least one discharge nozzle; a cylindrical blast tube surrounds the air deflector sleeve and an outlet end of the cylindrical blast tube supports a flame retention head; a supplemental air fan supplies supplement air into an inlet end of the blast tube for supplying supplement air to assist with combustion; an air deflector disk supports the at least one discharge nozzle within the blast tube, and the air deflector disk being located between the fuel discharge body and the inlet section of the air deflector sleeve; the method comprising the step of: permitting a minor portion of the supplement air to flow through openings in the air deflector disk and into the combustion chamber while redirecting a remaining portion of the supplement air toward the flame retention head; and directing some of the supplemental air, via the flame retention head, axially through apertures in the flame retention head into a burner box, and redirecting a remaining portion of the supplemental air through a plurality of apertures formed in the outlet section of the air deflector sleeve to assist with combustion of the fuel mixture.

BRIEF DESCRIPTION OF THE DRAWINGS

The invention will now be described, by way of example, with reference to the accompanying drawings in which:

FIG. 6A is an enlarged diagrammatic cross sectional view of the fuel and air orifices of FIG. 6;

FIG. 8 is a diagrammatic view showing the fuel mixture discharge pattern for the concentric fuel and pressurized air discharge orifices;

FIGS. 10A and 10B are diagrammatic sectional views which show the arrangement of the discharge nozzle, the air deflector sleeve and the blast tube;

FIG. 10C is a diagrammatic view of the outlet end of the air deflector sleeve;

FIG. 10D is a diagrammatic view of the inlet end of the air deflector sleeve of FIG. 10C;

FIG. 10E is an enlarged diagrammatic cross-sectional view which shows the interface between the blast tube, the flame retention head and the outlet end of the air deflector sleeve;

DETAILED DESCRIPTION OF THE INVENTION

Figure 1:
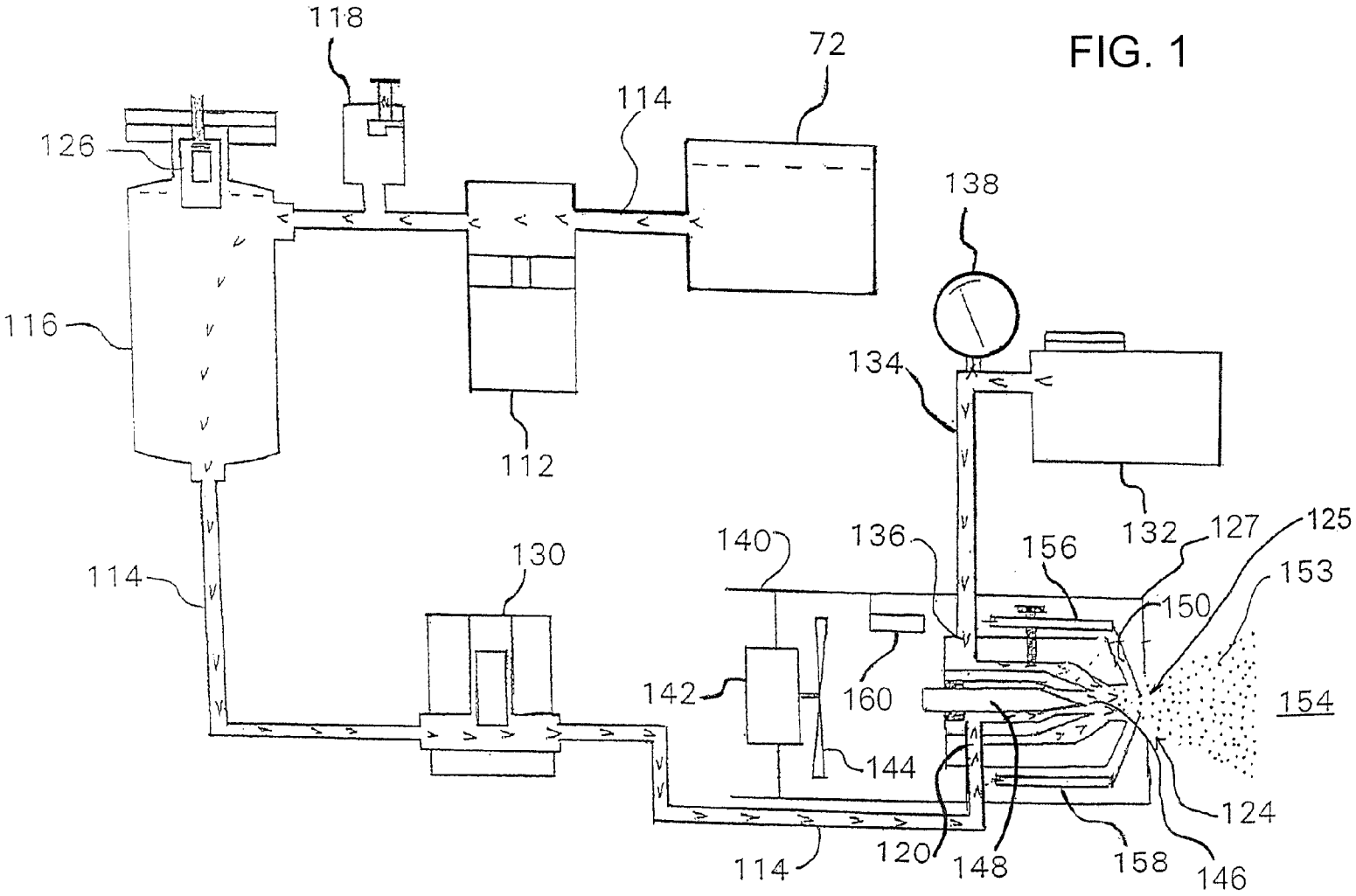
FIG. 1 is a diagrammatic view of a first embodiment of the improved fuel combustion system showing further details thereof.

Turning first to FIG. 1, a detailed description concerning a first embodiment of the fuel combustion system 2, according to the present invention, will be described. As shown therein, the fuel combustion system 2 generally comprises a liquid fuel supply storage tank 72, e.g., having a storage capacity of approximately 10 to a 300 gallons or more, for example, for storing a desired petroleum product such as No. 2 home heating oil, kerosene, diesel fuel, bio-diesel fuel or some other combustible fuel. A liquid fuel pump 112 is coupled to the liquid fuel supply storage tank 72, via a first section of a liquid fuel supply conduit 114, for pumping the liquid fuel from the liquid fuel supply storage tank 72 to a burner 122 for eventual combustion. A further section of a liquid fuel supply conduit 114 couples the liquid fuel pump 112 to a liquid fuel reservoir 116 for supplying the liquid fuel thereto. Typically either the liquid fuel supply conduit 114 or the liquid fuel reservoir 116 is provided with a conventional hydronic air vent 118 which allow the liquid fuel reservoir 116 to breath, e.g., facilitates the replenishment or the addition of air thereto, as the liquid fuel is removed therefrom during operation of the combustion system 2. As diagrammatically shown in FIG. 1, the hydronic air vent 118 is shown coupled to the liquid fuel supply conduit 114 but other conventional arrangements also fall within the spirit and scope of this invention.

The liquid fuel reservoir 116 typically holds between 8 ounces and 128 ounces of liquid fuel therein and, as discussed below in further detail, is generally a gravity reservoir which operates at a very slight positive pressure, e.g., a positive pressure of between approximately 1-35 inches of water (e.g., generally less than 1⅓ PSI), Typically, the liquid fuel reservoir 116 is equipped, adjacent a vertically uppermost portion thereof, with a float valve 126 which is coupled to a float switch 128. The float switch (not shown) controls operation of the liquid fuel pump 112 to facilitate turning the liquid fuel pump 112 "on" and "off" so that the liquid fuel pump 112 may be automatically controlled and operated to supply, as necessary, the liquid fuel from the liquid fuel storage tank 72 to the liquid fuel reservoir 116 during operation of the combustion system 2.

An outlet of the liquid fuel reservoir 116 is coupled, via a third section of the liquid fuel supply conduit 114, to a liquid fuel inlet 120 of a discharge nozzle 124. A liquid fuel solenoid valve 208, e.g., an solenoid valve manufactured by ASCO Red-Hat Valves of N. Cuthbert Inc. of Toledo, Ohio or Automatic Switch, Co. for example, is provided along the third section of the liquid fuel supply conduit and this valve, when the liquid fuel solenoid valve 208 is activated or open, allows the flow of the liquid fuel from the liquid fuel reservoir 116 to the discharge nozzle 124 and, when the liquid fuel solenoid valve 208 is deactivated or closed, interrupts the flow of the liquid fuel from the liquid fuel reservoir 116 to the discharge nozzle 124. A further detailed discussion concerning the supply, mixing, discharge and combustion of the liquid fuel will follow below.

An air compressor 132, e.g., an oil-less air compressor, is coupled, via an air supply conduit 134, to a compressed air inlet 136 of the discharge nozzle 124 for supplying compressed air thereto. The air supply conduit 134 typically includes an air pressure gauge 138 for detecting and displaying the supply pressure of the compressed air being supplied by the air compressor 132 to the discharge nozzle 124. The compressed air is typically supplied to the discharge nozzle 124, via the air compressor 132, at an air pressure of between 2 and 30 psi and more preferably supplied at an air pressure of about 20 psi or less, or preferably at a pressure between about 4 psi and 8 psi. A further detail discussion concerning mixing of the compressed air with the liquid fuel and combustion of that fuel mixture 153 will follow below. The fuel is typically supplied at a pressure of between 0.25 psi and about 2 psi and more preferably at a fuel supply pressure of 0.5 psi.

Figure 2A:
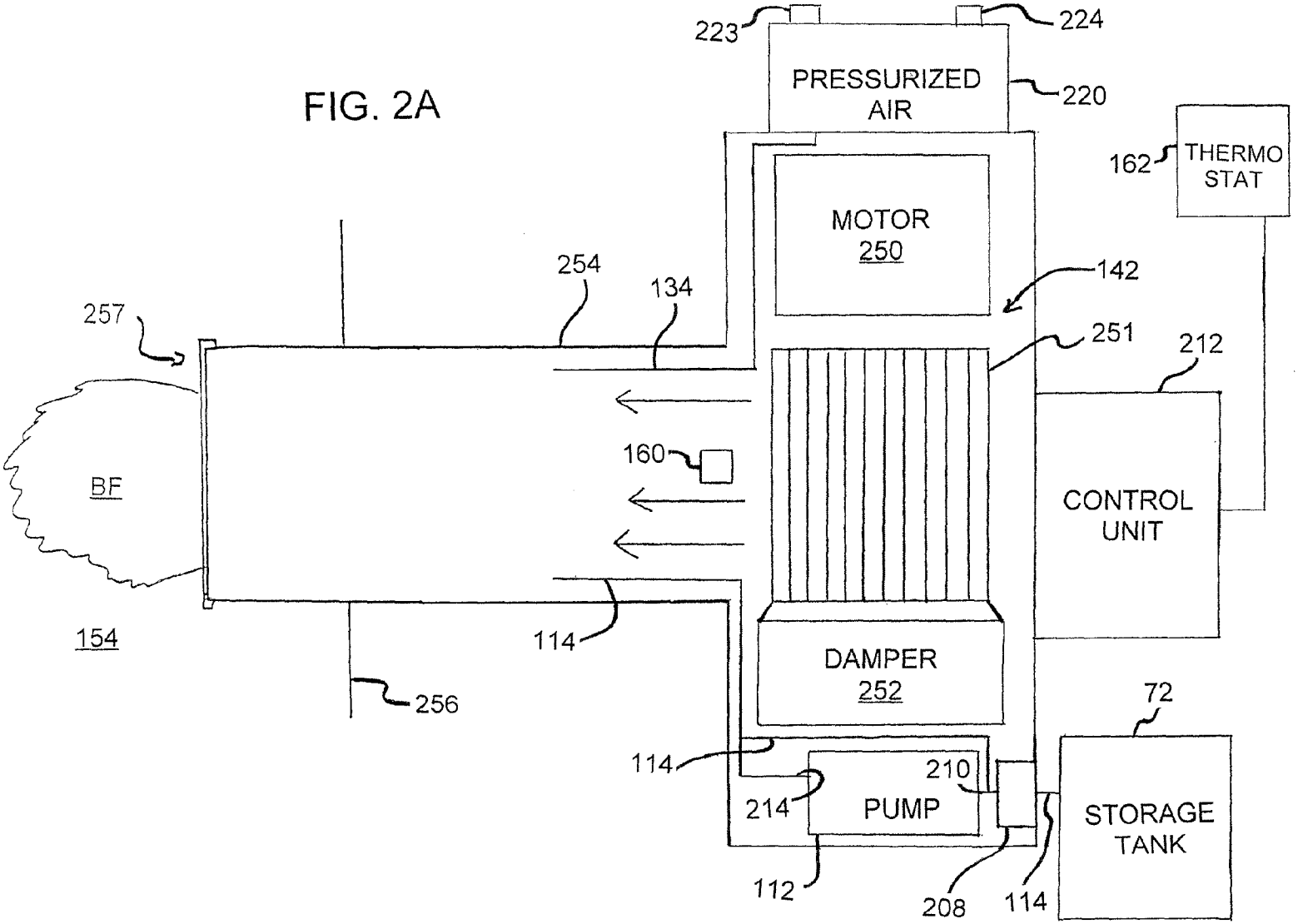
FIG. 2A is a diagrammatic view of another embodiment of the improved fuel combustion system showing details of the blast tube, motor and air source.

The discharge nozzle 124 is typically accommodated and located within and enclosed by a cylindrical blast tube 254 (see FIG. 2). The cylindrical blast tube 254 typically has a diameter of between 4 and 6 inches and a length of between 4 and 24 inches with the discharge orifices of the discharge nozzle 124 being located closely adjacent an outlet end of the cylindrical blast tube 254. A blast tube fan 142 is located upstream and behind of the discharge nozzle 124, and communicates with an inlet end of the cylindrical blast tube 254, for supplying additional combustion air to the fuel mixture 153 being atomized and discharged from the orifices of the discharge nozzle 124 during operation of the combustion system 2. This additional combustion air, along with the compressed air supplied by the air compressor 132, facilitates substantially complete combustion of all of the liquid fuel as the liquid fuel/compressed air mixture ignites, burns and is consumed within the furnace 154. The blast tube fan 142 typically supplies between 10 and 120 cubic feet per minute or so of additional combustion air and more preferably supplies about 80 cubic feet per minute or so of additional combustion air. Preferably the rotational speed of the blast tube fan 142 is variable or adjustable so as to allow adjustment of the rotational speed of the fan blades 144 and thereby the amount of additional air which is supplied to and mixes with the liquid fuel/compressed air mixture 153 discharged by the discharge nozzle 124 into the furnace 154 to thereby result in optimal and substantially complete combustion of all of the liquid fuel during operation of the combustion system 2.

The discharge nozzle 124 generally comprises a fuel orifice and a concentric nozzle pressurized air orifices which are aligned with a nozzle orifice 125 formed in a cover 127 of the discharge nozzle 124. The liquid fuel is supplied to and discharged via the fuel orifice 146 and an internal needle valve 148 cooperates with the fuel orifice 146 to facilitate adjustment of the flow rate of the liquid fuel therethrough during operation of the combustion system 2. Rotation of the internal needle valve 148, in a first rotational direction, decreases the cross-sectional flow area, between an exterior surface of the needle valve 148 and an inwardly facing surface of the fuel orifice 146 thereby restricting the flow rate of the liquid fuel that is permitted to pass therethrough and be exhausted by the fuel orifice 146.

Rotation of the internal needle valve 148, in the opposite direction, increases the cross-sectional area, between an exterior surface of the needle valve 148 and the inwardly facing surface of the fuel orifice 146 thereby increasing the flow rate of the liquid fuel that is permitted to pass therethrough. As it is desirable to minimize the amount of liquid fuel being consumed, preferably the needle valve 148 is adjusted toward a minimal liquid fuel flow position. In this way, only the smallest amount of liquid fuel, e.g., between 2 and 40 ounces of liquid fuel per hour, for example, may flow through the liquid fuel inlet and be discharged by the fuel orifice 146. Regardless of the actual amount however, this invention allows for the flow rate to be adjusted by an operator to achieve optimum utilization of the liquid fuel.

A compressed air chamber 150, which typically has a relatively small size of only about one to three cubic inches or less, is formed within the discharge valve 124, between an inwardly facing surface of cover 127 and the fuel and air orifices, and this chamber 150 generally encloses or encases the air and the fuel so that the liquid fuel is initially exhausted directly into the compressed air chamber 150 for mixing with the compressed air. The external orifice 125 is typically concentric with but spaced from both the fuel and the air orifices so as to provide sufficient area for the liquid fuel to mix with the compressed air, within the compressed air chamber 150, prior to the combined liquid fuel and compressed air fuel mixture 153 being accelerated and discharged, via external orifice 125, into the furnace 154 for combustion.

A compressed air valve (not shown) may cooperates with an associated compressed air needle valve (not shown) to control the flow of the compressed air which is allowed to flow into the compressed air chamber 150 and the compressed air needle valve allows fine tuning adjustment of the compressed air flow into and through the compressed air chamber 150 for mixing with the liquid fuel and forming the fuel mixture 153 which is then discharged, via the external orifice 125 of the discharge nozzle 124, into a combustion zone of the furnace 154. Rotation of the compressed air needle valve, in a first rotational direction, decreases the cross-sectional flow area, between an exterior surface of the compressed air needle valve and the inwardly facing surface of the compressed air nozzle, and thereby restricts the flow rate of the compressed air that is allowed to flow into the compressed air chamber 150 and mix with the liquid fuel, while rotation of the compressed air needle valve, in the opposite direction, increases the cross-sectional flow area, between an exterior surface of the compressed air needle valve and the inwardly facing surface of the compressed air valve, and thereby increases the flow rate of the compressed air that is permitted to flow into the compressed air chamber 150 and mix with the liquid fuel and be discharged by the external orifice 125.

Preferably both the liquid fuel needle valve 148 and the compressed air needle valve each have a very fine thread to allow minute, fine adjustment of the flow of the liquid fuel and the compressed air, respectively, so that an optimized flame, e.g., the blue flame, can be achieved within the furnace as the fuel mixture 153 is consumed during operation of the combustion system 2.

As the compressed air flows into through the compressed air chamber 150, the compressed air flows around and/or over the fuel orifice, the compressed air tends to create a vacuum which assists with sucking, withdrawing and/or evacuating the liquid fuel through the fuel orifice. The slight positive pressure of the liquid fuel also assists with discharging the liquid fuel from the fuel orifice 146.

As the compressed air is under pressure, e.g., 2-30 psi for example, the compressed air along with the liquid fuel evacuated from the fuel orifice normally swirls and adequately mixes with the withdrawn liquid fuel and the resulting fuel mixture 153 is then discharged out through the external orifice 125 in a substantially atomized form, e.g., following discharge the liquid fuel typically has a droplet or particle size of between 5 and 50 microns and more preferably 20 to 35 microns, for example. Due to such fine liquid fuel particle size and due to the fact that the liquid fuel is sufficiently mixed with an ample supply of oxygen contained within the compressed air, substantially all of the liquid fuel is immediately burned and consumed within the furnace 154 upon being discharged from the discharge nozzle 124.

To assist further with such combustion, the blast tube fan 142 (see FIG. 2) supplies additional supplemental air which facilitates substantially complete combustion of the fuel mixture 153. The blast tube fan 142 assists with controlling axial length and with or diameter of the flame which is combusting and burning within the furnace 154 and thus also assists with controlling the spacing of the flame from the one or more discharge nozzle(s) 124.

The external orifice 125 typically has about 0.4 mm diameter opening therein while the fuel orifice 146 typically has a 0.2-4 mm diameter opening therein, e.g., both nozzles have a diameter of between 0.01 and 0.8 millimeters.

Figure 3:
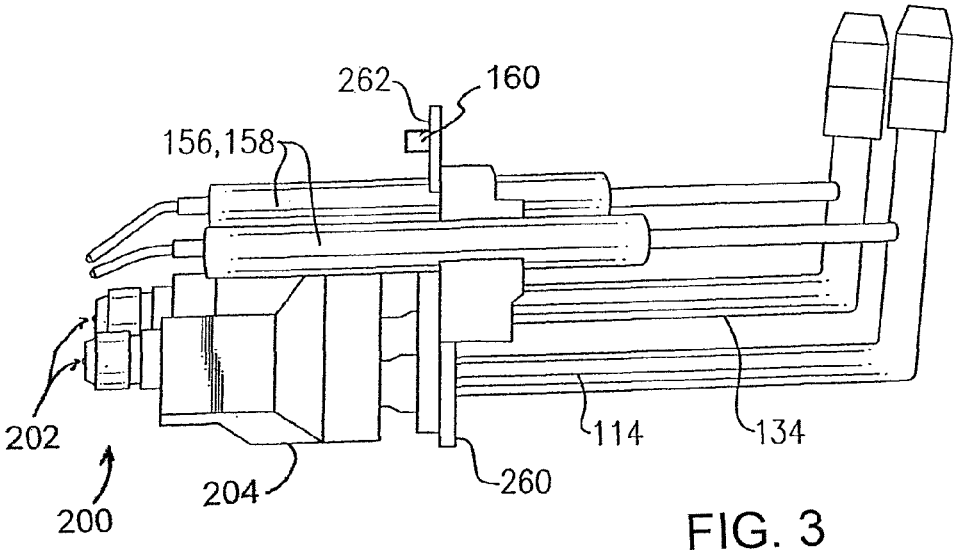
FIG. 3 is a diagrammatic top, right side perspective view of the discharge nozzles and pair of electrodes (igniters)

As shown in FIG. 3, the combustion system 2 is provided with a pair of conventional electrodes (igniters) 156, 158 to facilitate ignition of the fuel mixture 153. Each conventional electrode (igniter) 156 and 158 has an ignition tip located closely adjacent the discharge nozzles 124, e.g., approximately ¼ of an inch to an 1 inch or so in front of the external orifice with the electrode tips being spaced apart from one another by about ¼ of an inch to about ½ of an inch or so. In addition, a conventional flame detector 160 is normally positioned upstream of the electrodes 156, 158 and located for direct viewing and detecting the presence of a flame, in an area immediately in front of the external orifice 125, to confirm whether or not a flame is present. In the event that the flame detector 160 does not detect a flame, a lack of flame signal is then supplied, in a conventional manner, to the control unit 212 which then interrupts the flow of liquid fuel and/or compressed air to the discharge nozzle 124 and again initiates an ignition cycle of the flame, in a conventional manner. However, in the event that the flame detector 160 detects the presence of a flame resulting from the combustion of the fuel mixture 153, then such information is conveyed to the control unit 212 which allows the burner to continue to operate and generate heat until a sufficient amount of heat is generated within the furnace 154 as detected by a thermostat 162, for example, located at one or more suitable locations within the building to be heated.

The liquid fuel reservoir 116 is typically located vertically above the external orifice 125 of the discharge nozzle 124 so that liquid fuel, contained in the liquid fuel reservoir 116, creates a head of liquid which provides a slight positive pressure which causes the liquid fuel, within the liquid fuel reservoir 116, to flow from the liquid fuel reservoir 116 toward the liquid fuel inlet 120 of the discharge nozzle 124 when liquid fuel solenoid valve 208 is open. Typically the liquid fuel reservoir 116 is installed so that a distance or spacing of the liquid fuel, i.e., a top surface of the liquid fuel contained within the liquid fuel reservoir 116, is between about 0.1 and about 35 inches above a height of the external orifice 125 of the discharge nozzle 124, It is to be appreciated that the actual positive dispensing pressure of the liquid fuel, from the liquid fuel reservoir 116, will vary and depend upon the relative vertical spacing or distance between the top surface or level of the liquid fuel, contained within the liquid fuel reservoir 116, and the external orifice 125 of the discharge nozzle 124.

The cylindrical blast tube 254 is equipped with an exterior adjustable flange 256 (see FIGS. 2A and 2B), slidable and adjustably mounted on an exterior surface thereof, to facilitate attaching the outlet end of the blast tube 254 to a conventional burner opening of a conventional boiler or furnace 154. Preferably the flange 166 is slidably adjustable along the exterior surface of the cylindrical blast tube 254, in a conventional manner, to facilitate adjustment of the distance or the extent to which the outlet or discharge end of the blast tube 254 projects into the furnace 154 so that the burner flame is optimally located and positioned within the furnace 154 for generating a maximum amount of heat while, at the same time, consuming a minimal amount of liquid fuel and generating a minimal amount of soot within the furnace 154.

The liquid fuel is generally supplied along the central axis of the discharge nozzle 124 and the liquid fuel needle valve 148 can be minutely or finely adjusted to vary the flow of liquid fuel which is allowed to be fed at very slight positive pressure, through the liquid fuel orifice 146. The compressed air generally enters the discharge nozzle circumferentially about the fuel orifice 146 and the compressed air, along with the evacuated and/or sucked liquid fuel, are then mixed with one another and are constricted and accelerated as that the fuel mixture 153 is discharged out through the external orifice 125 of the discharge nozzle 124. As a result, the fuel mixture 153 is substantially vaporized and/or atomized, upon being discharge therefrom, is thus immediately able to be rapidly consumed and burned within the furnace 154 while still minimizing consumption of fuel and maximizing the generation of heat within the furnace 154.

As is conventional in the art, it is desirable that the exhaust fumes, exhausted from the furnace 154 and via the chimney, typically have a temperature of at least 350° F. and, most preferably, have a temperature approaching 450° F., but typically no greater than 450° F. By adequately adjusting the supply pressure and/or the flow rate of the liquid fuel, the supply pressure and/or flow rate of the combustion air and/or the rotational speed of the blast tube fan 142, an operator is readily able to modify, adjust and/or alter the burner characteristics so as to achieve substantially complete combustion of the fuel mixture 153 and thereby vent exhaust gases from the furnace 154 which have a temperature approaching, but typically no greater than, 450° F.

This embodiment of the combustion system 2 operates as follows. When a building or other structure or facilitate requires heat, the thermostat 162 is triggered or activated and the send a control signal to control unit 212 which activates the air compressor 132 to commence supplying compressed air to the discharge nozzle 124. In addition, the liquid fuel solenoid valve 208 is also simultaneously actuated or opened to thereby allow the flow of the liquid fuel therethrough from the liquid fuel reservoir 116 to the fuel orifice 146. Further, the blast tube fan 142 is turned on so as to supply supplemental combustion air to the burner. The pair of conventional electrodes 156, 158 are also activated, in a conventional manner by a conventional electronic fuel igniter, for igniting the fuel mixture 153 as this fuel mixture is discharged from the external orifice 125 of the discharge nozzle(s) 124.

Assuming that a flame is detected by the flame detector 160, the air compressor 132, the liquid fuel solenoid valve 208, and the blast tube fan 142 will all remain in an active, operating state until the thermostat 162 eventually determines, in a conventional manner, that sufficient heat has been generated for the building or other structure requiring heat. Once this occurs, the thermostat 162 will send a signal to the control unit 212 and the control unit 212 will shut off the air compressor 132, which interrupts the supply of compressed air to the discharge nozzle 124, and also close the liquid fuel solenoid valve 208, which interrupts the flow of liquid fuel to the discharge nozzle 124, and discontinue the supply of electricity to the blast tube fan 142 to thereby terminate combustion of the fuel mixture 153 within the furnace 154. It is to be appreciated that the control unit 212 may be programmed to allow the blast tube fan 142 to continue to operate for a short duration of time, e.g., 10 seconds to a few minutes or so, after the flame is discontinued, in order to facilitate purging of any remaining and/or unconsumed fuel mixture 153 from the burner and/or the furnace 154.

Combustion of the fuel mixture 153, within the furnace, generates sufficient heat therein and this heat, in turn, is transferred to the associated heating system of the building or other structure, in a conventional manner, which then circulates and distributes the heat in a conventional manner throughout the building or other structure to be heated. The transfer medium, e.g., water or air via a heat exchanger, is then returned to the furnace 154 to be reheated for further redistribution of heat via the associated heating system. Once the building or other structure is sufficient heated, the control unit 212 automatically shuts down the fuel combustion system which, in turn, shuts or turns off the liquid fuel solenoid valve 208, the air compressor 132, and the blast tube fan 142.

Turning now to FIGS. 2B-8, a description concerning modifications of the fuel combustion system 2, according to the present invention, will now be described in detail. As a number of elements and features are somewhat similar to those previously described, only the differences between the new and the previously described elements and features will now be described in detail.

According to this embodiment, the fuel discharge head 200 comprises common nozzle housing 204 supporting a pair of discharge nozzles 202 which are arranged closely adjacent one another, see FIGS. 2B, 3, 4 and 5A-5D, for example. Each discharge nozzle 202 has a liquid fuel orifice 215 and an air orifice 217 surrounding and located concentrically with respect thereto. The liquid fuel orifice 215 is designed to discharge a liquid fuel component substantially concentrically with respect to and surrounded by a pressurized air component, from the air orifice 217, directly into an interior chamber of the air deflector for intimate mixing with one another and formation of a fuel mixture 153 that may be substantially complete consumed within the furnace 154, and a further detail description concerning the features of each discharge nozzle 202 will be provided below.

This embodiment of the invention utilizes a discharge nozzle 124 such as a Binks Model 460 automatic spray nozzle (manufactured Binks Manufacturing Company, Franklin Park, II and distributed by ITW Industrial Finishing of Glendale Heights, Ill.). This type of spray nozzle is conventionally used to atomize and spray paint for painting a surface. The inventors have determined that an automatic spray nozzle which sufficiently mixes the liquid fuel with an ample supply of oxygen from a combustion source, such as compressed air, and also atomizes the liquid fuel, upon being discharged from the nozzle, is sufficient for use with the present invention.

As generally shown in FIG. 2, liquid fuel is stored within a liquid fuel storage tank 72 and an inlet to the liquid fuel pump 112 is coupled to the liquid fuel storage tank 72, via a first section of the fuel supply conduit 114, for pumping the liquid fuel therefrom to the one or more discharge nozzles 202. A liquid fuel solenoid valve 208 is located along this section of the fuel supply conduit 114, e.g., adjacent the inlet to the liquid fuel pump 112, for interrupting the flow of liquid fuel to the fuel pump 112. The liquid fuel solenoid valve 208 is coupled to the burner control unit 212, in conventional manner, for controlling opening the liquid fuel solenoid valve 208 and the fuel pump 112, when the combustion system is operating, and closing the liquid fuel solenoid valve 208 and the fuel pump 112, when the fuel combustion system shuts down. The outlet of the fuel pump 112 is connected to supply fuel to the one or more discharge nozzles 202. Alternatively, an outlet of the fuel pump 112 may be connected to a circulating section of the fuel supply conduit 114 (not shown) while an opposite end of the circulating section of the fuel supply conduit 114 is connected back to the fuel supply conduit 114 adjacent the connection of the fuel supply conduit 114 to the inlet to the fuel pump 112. The circulating section of the fuel supply conduit 114 assists with circulating a majority of the pumped fuel back into the inlet of the fuel pump 112 to form a continuous loop which maintains the fuel at a desired supply pressure.

The fuel supply section of the fuel supply conduit 114 is connected with the liquid fuel supply conduit 114 of the nozzle housing 204 for supply to the respective fuel orifices 215 of each fuel discharge nozzle 202. A fuel regulator 298 (see FIG. 2B, 9, 11A-11E) is located along the fuel supply section of the fuel supply conduit 114 for reducing the supply pressure of the liquid fuel supplied by the fuel pump 112 to each respective fuel orifice 215 of the discharge nozzle 202. The fuel regulator 298 typically has an opening therein, e.g., between 0.0015 and 0.0030 of an inch for example, and this opening allows the pressurized liquid fuel to flow from the fuel pump 112 toward the discharge nozzle 202 while reducing the supply pressure of the liquid fuel being supplied thereto. The fuel pump 112 typically supplies pressurized liquid fuel at a pressure of between 70 and 300 psi, for example, while the pressure of the supplied liquid fuel, after passing through the fuel regulator 298, is typically reduced to a pressure of between about 0.5 psi and 2.0 psi, more preferably to a supply pressure of about 1.5 psi. It is to be appreciated that the liquid fuel pressure can vary and generally depends upon the overall fuel combustion system requirements. In order to facilitate fine turning of the flame characteristics, the fuel regulator 298 is also readily interchangeable so that another fuel regulator 298, having either a slightly larger or a slightly smaller opening therein, may be installed within the fuel supply conduit 114 so as to alter the pressure and/or flow rate of the liquid fuel supplied to the discharge nozzle(s) 202 and thus modify or alter the characteristics of the flame BF in the furnace 154.

Preferably a 10 micron fuel filter 218, which only permits particles that are smaller than 10 microns in size to flow therethrough, is also located along the fuel supply conduit 114 for preventing large particles and/or debris from flowing therealong and potentially clogging or otherwise obstructing the fuel regulator 298 or the fuel orifice(s) 215 of the discharge nozzle(s) 202. It is to be appreciated that this fuel filter 218 may require periodic cleaning/replacement. Preferable the fuel filter 218 is locate upstream of the fuel regulator 298 in order to remove small particulate matter and/or other debris, from the liquid fuel supply, before the same can flow into the fuel regulator 298 and obstruct and/or clog the restrictor and/or the fuel orifice(s) 215 of the discharge nozzle(s) 202.

Preferably the fuel pump 112 is a low flow rate fuel pump which typically pumps between about 1 gallon per hour to about 4 gallons per hour at a pressure of between about 70 psi and about 300 psi, for example.

As with the previous embodiment, the pressurized air is generally supplied by an air compressor or some other pressurized air source 220. The compressed air is supplied by a pressurized air supply conduit 134 toward the one or more discharge nozzles 202. A pressurized air solenoid valve 222 is located along the pressurized air supply conduit 134 for interrupting the flow of the pressurized or compressed air to the one or more discharge nozzles 202, when the fuel combustion system is inactive. The pressurized air solenoid valve 222 is coupled to a burner control unit 212, in a conventional manner, for opening the pressurized air solenoid valve 222 when the fuel combustion system is operating and closing the pressurized air solenoid valve 222 when the fuel combustion system turned off or shuts down. Typically, the air compressor 220 will supply compressed air at the pressure of about 3-15 psi, and more preferably at a pressure of about 6 psi±2 psi and at a flow rate at between 1 and 1.5 cubic feet per minute. It is to be appreciated that for commercial embodiments, the flow rate of the compressed air may be somewhat higher, e.g., at a flow rate of about 3 cubic feet per minute, and the pressure of the supplied air may be also be somewhat higher as well.

Preferably, the air compressor 220 has a pair of adjustment controls, e.g., a first adjustment control for adjusting the flow rate of the compressed air being supplied by the air compressor and a second adjustment control for adjusting the pressure of the supplied compressed air. In addition, a replaceable air flow restrictor 248 may be provided along the air supply conduit 134, between the air compressor 220 and the one or more discharge nozzles 202, to further assist with fine tuning the flow rate and the pressure of the pressurized or compressed air that is actually being supplied to each pressurized air orifice 217. The air restrictor 248 typically has an opening therein of between 0.0020 and 0.0040 of an inch, and this opening allows the compressed air to flow from the air compressor toward the one or more discharge nozzles 202 while reducing the pressure of the supplied compressed air. In order to facilitate fine turning of the flame characteristics, the air restrictor 248 is readily interchangeable with another air restrictor 248, either having a slightly larger or a slightly smaller opening therein, with the air supply conduit 134 so as to alter the characteristics of the air supplied to the discharge nozzle(s) 202 and thus the characteristics of the flame in the furnace 154. If desired, an air filter (not shown) is located upstream of the air restrictor 248 so as to filter out small particulate matter from the air compressor 132 before the same can flow into the air restrictor 248 and possibly obstruct and/or clog the air restrictor 248 and/or any air orifice 217.

It is to be appreciated that this embodiment (as well as the third embodiment discussed below) utilizes discharge nozzle(s) 202 in which the pressurized air and liquid fuel both exit the discharge nozzle 202 independently of one another through respective fuel and air orifices 215, 217. That is, the pressurized air and liquid fuel do not interact or mix within the discharge nozzle(s) 202 but instead, only combine and mix with one another immediately upon being discharged from the respect orifices outside of the discharge nozzle(s) 202. As a result, the air and liquid flow rates can be independently controlled and adjusted thereby allowing for precise adjustment of the fuel and air flow. This also allows for adjustment of the fuel atomization which can be controlled by adjusting the air flow rate without increasing the fuel rate, for example.

The pressurized or compressed air assists with atomizing the fuel, upon being discharge, into a particle size of between about 30 and about 35 microns±5 microns. The pressurized or compressed air further facilitates mixing of the two components with one another to form a desired fuel mixture 153 for combustion. The inventors have determined that if the liquid fuel has a particle size significantly greater than about 35 microns, e.g., above 50 microns for example, then some of the liquid fuel particles may not be completely burnt and/or consumed and such unburnt particles may be exhausted up the flue. In addition, the inventors have found that if the liquid fuel particle size is significantly smaller than about 30, e.g., below 20 microns, then it is somewhat difficult to sustain continuous combustion of the fuel mixture 153 and a portion of the fuel mixture 153 may inadvertently be exhausted up the flue without being burnt and/or consumed within the furnace 154.

As is conventional in the prior art, a blast tube fan 142, e.g., a squirrel cage type fan for example, is provided for supplying additional supplement air to the furnace 154 and to the one or more discharge nozzles 202 to assist with substantially complete combustion. An electric motor 250 typically drives or rotates the squirrel cage 251 of the blast tube fan 142 at a desired rotational speed and in a desired direction. It is to be appreciated that the rotational speed of the blast tube fan 142 can be varied, in a conventional manner as desired, for varying the flow rate of the supplemental air supplied to the one or more discharge nozzle(s) 202 which assists with complete combustion of the fuel mixture 153. In addition, as is conventional in the prior art, a size of an air inlet(s) for the blast tube fan 142 is adjustable by one or more dampers 252, for example, to vary the amount of air which is actually permitted to enter into and be supplied by the blast tube fan 142 to the discharge nozzle(s) 202. The blast tube fan 142 is coupled to and controlled by the burner control unit 212 in a conventional manner. As such blast tube fan 142 and its operation and function are conventional and well known in the art, a further detailed discussion concerning the same is not provided.

As is also conventional in the art, a cylindrical blast tube 254 encases and surrounds the fuel supply conduit 114 and the fuel orifices 215, the pressurized air supply conduit and the air orifices 217, as well as the ignition components, such as the ignition electrode(s) 157, 158 and the discharge nozzle(s) 202. The blast tube 254 typically has a diameter of between about 2.5 to about 8 inches, more preferably a diameter of about 4±1 inches and a length of about 4 to about 10 inches, more preferably a length of about 7±2 inches. As is also conventional in the art, an adjustable mounting flange 256 is supported along the exterior surface of the blast tube 254 and this flange 256 has a plurality of exterior mounting apertures 258 formed therein (see FIG. 2B) which assist with mounting the flange 256 to an exterior surface of the furnace 154, via a conventional fastener, so that the outlet end 257 of the blast tube 254 can communicate with or project into and be located within the furnace 154 at a desired spaced location from the rear wall of the furnace 154. Preferably the flange 256 is adjustably mount to the exterior surface of the blast tube 254 so as to facilitate adjustment of the amount that the outlet end 257 of the blast tube 254 is permitted to protrude or project into the furnace 154.

A component support plate 260 may also be accommodated within the blast tube 254 for supporting the various components, e.g., the fuel supply conduit 114, the nozzle housing 204, the fuel discharge nozzle 202, and the ignition electrodes 157, 158, the pressurized air supply conduit 134, etc. The support plate 260 typically has at least a plurality of spacer legs (not shown), e.g., typically three spacer legs, which assist with maintaining the support plate 260 centrally located within the blast tube 254. The support plate 260 and the spacer legs, in turn, center and space the supported components from the surface of the blast tube 254 and also redirects and channels a majority of the supplemental air, supplied by the blast tube fan 142, radially outward and around the support plate 260. The support plate 260 typically has one or more small holes formed therein, e.g., between 1 and 3, which permit only a small or minor portion of the supplemental air, supplied by the blast tube fan 142, to pass through the support plate 260 and flow toward the one or more discharge nozzle(s) 202.

Figure 2B:
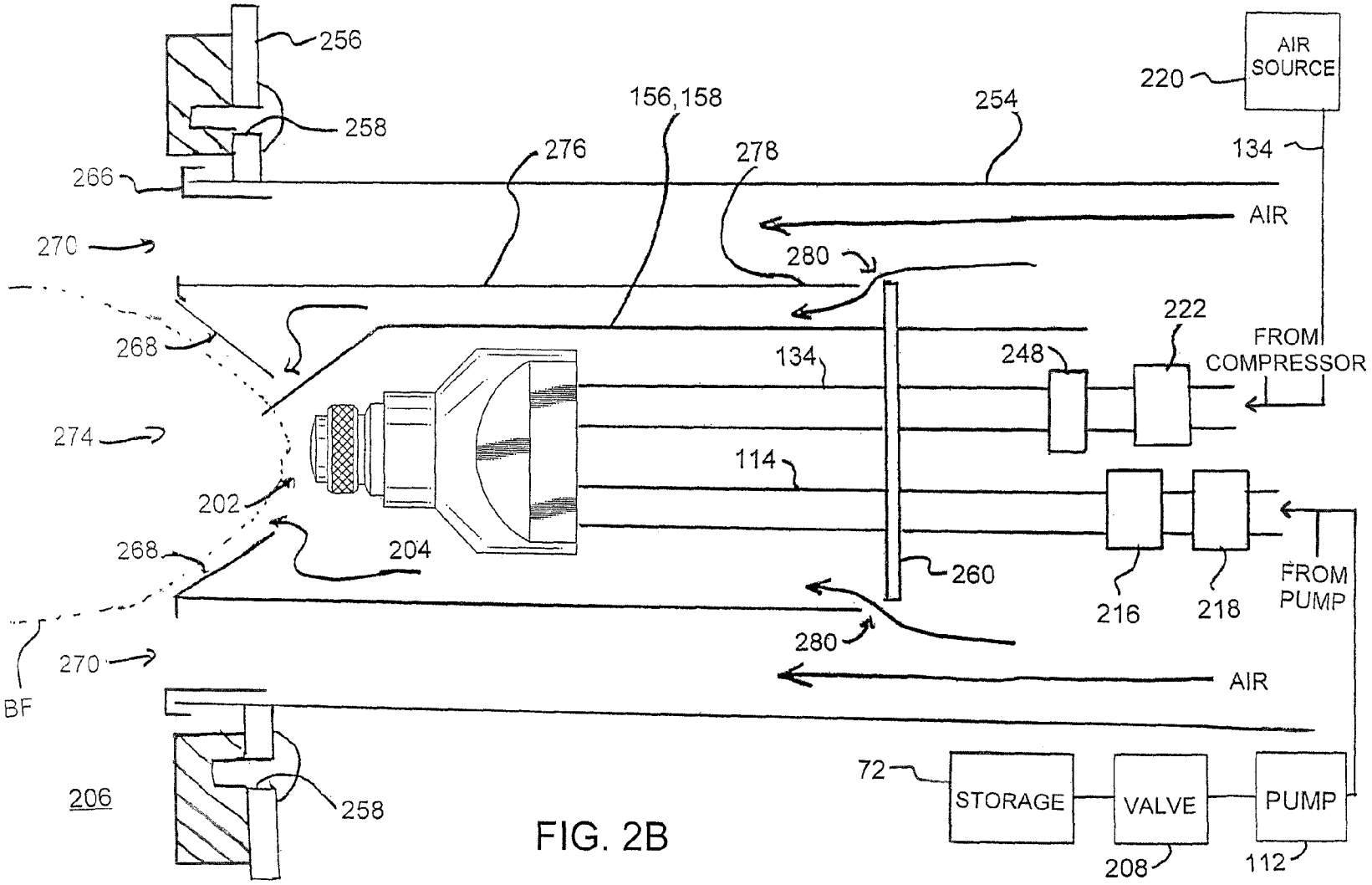
FIG. 2B is a diagrammatic view showing the blast tube components of FIG. 2A using a pair of discharge nozzle each having a concentric fuel and pressurized air orifices.
Figure 4:
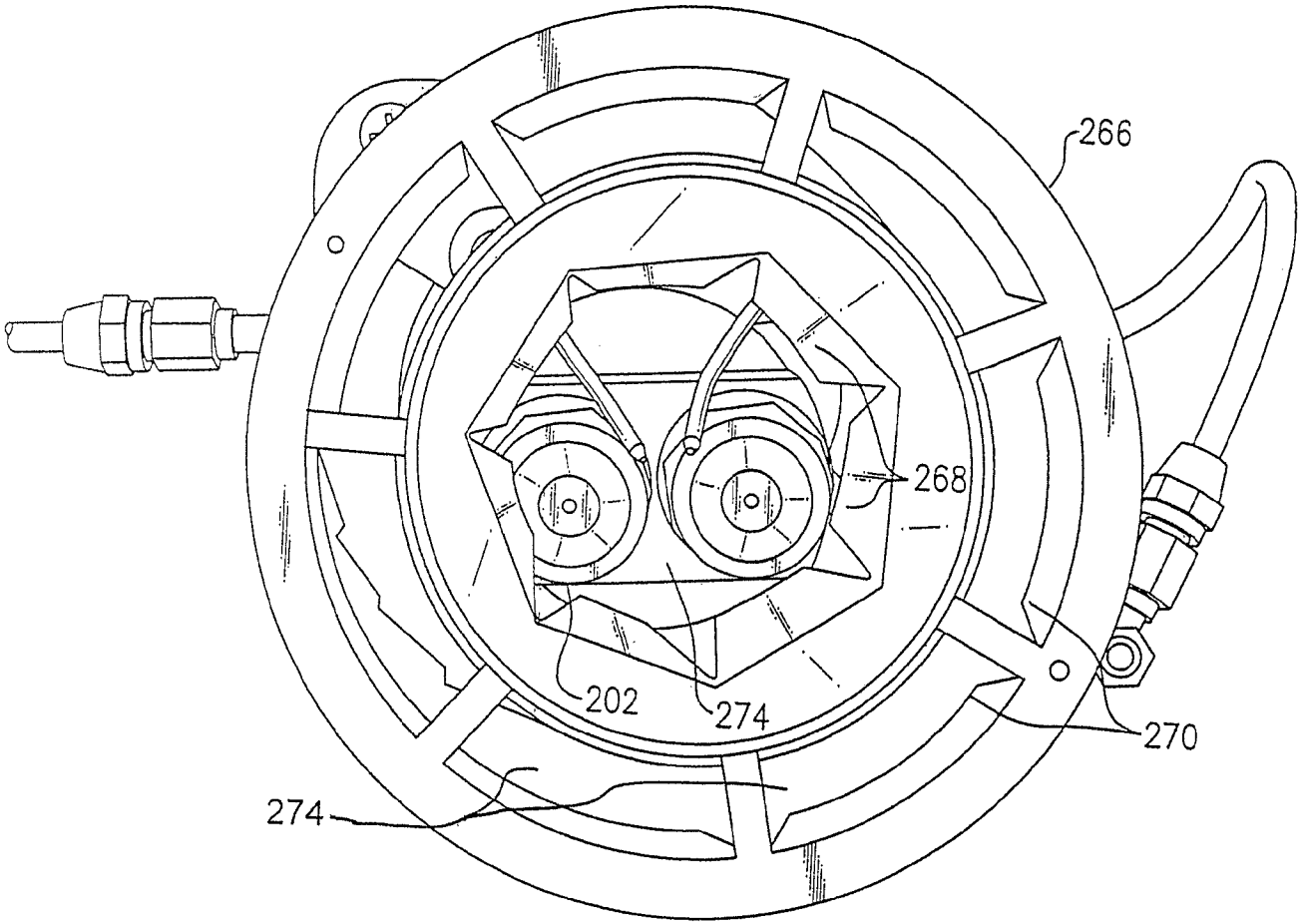
FIG. 4 is a diagrammatic front elevational view of a flame retention head, shown affixed to the outlet end of the blast tube with a pair of discharge nozzles.

A flame retention head 266 is supported by and partially accommodated within the outlet end 257 of the blast tube 254 (see FIGS. 2B and 4). In this embodiment, the flame retention head 266 supports a plurality, e.g., typically between about 4 and 12, radially inclined and inwardly extending deflectors 268 which are arranged to deflect some of the supplemental air, supplied by the blast tube fan 142, and a further discussion concerning the function and purpose of the same will follow below.

The flame retention head 266 has a plurality of spaced apart peripheral air outlets 270, e.g., typically between about 2 and about 15 and more preferably about 6-8 peripheral air outlets 270, formed in an outer periphery thereof. It is be appreciated that the overall design characteristics of the flame retention head 266 are dictated somewhat by the furnace 154 and the characteristics of a remainder of the fuel combustion system. The peripheral air outlets 270 are generally equally spaced about the circumference of the flame retention head 266 so as to funnel and generally slightly accelerate the supplemental air, supplied thereto, directly into the furnace 154 and provide supplemental air which assists with substantially complete combustion of the fuel mixture 153 as the fuel mixture 153 burns and is consumed within the furnace 154.

As noted above, the flame retention head 266 supports a plurality of radially inclined and inwardly extending deflectors 268 for deflecting some of the air supplied by the blast tube fan 142 radially outward away from the flame. Each one of the radially inclined and inwardly extending deflectors 268 has a bent region or surface 272 so that when a portion of the supplemental air, which is supplied by the blast tube fan 142, contacts the bent surface 272 of the deflectors 268, such air is caused to rotate or spin in either a clockwise or a counter clockwise direction, depending upon the orientation or direction in which the deflector surface 272 is bent. Such rotation of the supplemental air has a tendency to swirl or spin the flame BF in either a clockwise or a counter clockwise direction and this, in turn, has a tendency to assist with centering the flame within the furnace 154 and thus cause the flame BF to be tighter, denser and more compact. Such adjustment of the flame BF further by swirling or spinning supplement air assists with substantially complete combustion of the fuel mixture 153 prior to the fuel byproducts being exhausted from the furnace 154 up the flue or chimney.

According to the present invention, the plurality of radially inclined and inwardly extending deflectors 268, are inclined a further distance away from one another. Namely, according to this embodiment, the radially inclined and inwardly extending deflectors 268 are modified to deflect somewhat less supplemental air while allowing more air to pass through a central aperture 274 and thus interact with the flame BF without being either spun or swirled.

The additional inclination of the radially inclined and inwardly extending deflectors are generally required because the discharge nozzles have a wider liquid fuel dispensing spray pattern so that the central aperture through the flame retention head must also have a larger diameter to ensure that none of the emitted liquid fuel is sprayed at or contacts any of the radially inwardly arranged deflectors. If the fuel contacts the radially inwardly arranged deflectors, this can lead to the creation of soot and/or unburnt fuel.

According to this embodiment, a short cylindrical air deflector sleeve 276 is accommodated within the blast tube 254 (see FIG. 2B). The air deflector sleeve 276 is arranged generally concentric with the blast tube 254 and the support plate 260 and is provided to separate the blast tube 254 from the various burner components, e.g., the ignition components, the liquid fuel supply conduit 114 and the compressed air supply conduit 134 and the one or more discharge nozzles 202. An inlet section 278 of the air deflector sleeve 276 is located closely adjacent to the component support plate 260, e.g., is generally spaced therefrom by a distance of about a 1/16 of an inch to about 1/4 of an inch or so, so as to form an annular gap 280 therebetween which generally extends around the entire perimeter of the component support plate 260.

The air deflector sleeve 276 typically has a diameter which is generally the same size as the diameter of the component support plate 260. It is to be appreciated that the air deflector sleeve 276, alternatively, may have a diameter that is slightly larger than the component support plate 260 so that the air deflector sleeve 276 could extend over and surround the component support plate 260 and form the annular gap 280 therebetween or the air deflector sleeve 276 may have a diameter that is slightly smaller than the component support plate 260 and be spaced from the component support plate 260. This annular gap 280, between the support plate 260 and the inlet section 278 of the air deflector sleeve 276, provides a small annular opening through which some or a minor portion of the supplemental air, supplied by the blast tube fan 142, is permitted to flow and be supplied directly to the one or more discharge nozzle(s) 202 to assist with combustion. The supplement air, which flows in through this annular gap 280, is also useful in supplying supplemental air to the one or more discharge nozzle(s) 202 which assists with cooling the one or more discharge nozzle head(s) 202 and maintains them at a relatively low operating temperature.

The air deflector sleeve 276 typically has an axially length of three to four inches, for example, and generally extends from the support plate 260 to the flame retention head 266. The air deflector sleeve 276 is generally connected to the flame retention head 266, at a location between the peripheral air outlets 270 and the radially inclined and inwardly extending deflectors 268. The supplemental air which flows along toward the flame retention head 266, and is confined within the air deflector sleeve 276, and eventually abuts against the flame retention head 266 but is generally not able to pass through the flame retention head 266. Consequently, such supplemental air is diverted radially inward, by the radially inclined and inwardly extending deflectors 268, and swirled or spun by the bent surfaces 272 as some of this air passes through the central aperture 274. Due to this arrangement, a majority of the air supplied by the blast tube fan 142 passes between the exterior surface of the air deflector sleeve 276 and inwardly facing surface of the blast tube 254 toward the flame retention head 266 and is exhausted out through peripheral air outlets 270 of the flame retention head 266. That is, typically between about 90% to about 97% of the supplemental air is redirected by the component support plate 260 and the air deflector sleeve 276 and flows toward the peripheral air outlets 270 of the flame retention head 266 while only between about 3% and 10% of the supplied air, for example, either passes through the small holes in the component support plate 260 or through the annular gap 280 formed between the component support plate 260 and the inlet section 278 of the air deflector sleeve 276, and thereafter flows toward the one or more discharge nozzle(s) 202. The supplemental air, which passes through the small holes in the component support plate 260 or through the annular gap 280, assists with cooling the one or more discharge nozzle(s) 202 and also with inducing a swirling or spinning motion of the supplemental air, as this supplement air contacts the bent surface 272 of the deflectors 268 of the flame retention head 266. Such swirling or spinning supplemental air assists with centering the flame BF within the furnace 154.

It is important to control the amount of supplemental air which flows through the annular gap 280 and directly communicates with the one or more discharge nozzle(s) 202. During operation of the burner, it is desirable to maintain the flame BF as close as possible to but spaced a small distance from the one or more discharge nozzle(s) 202, e.g., the flame BF is typically spaced about a quarter of an inch or so away from the one or more discharge nozzle(s) 202. Such spacing of the flame BF, from the one or more discharge nozzle(s) 202, generally results in the generation of an efficient flame, e.g., a blue flame, while also preventing the one or more discharge nozzle(s) 202 from becoming fouled and/or overheated during operation of the fuel combustion system.

Figure 5C:
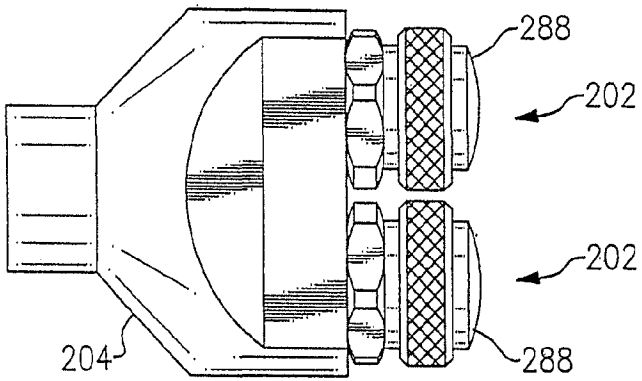
FIG. 5C is a diagrammatic top plan view of FIG. 5A.
Figure 5B:
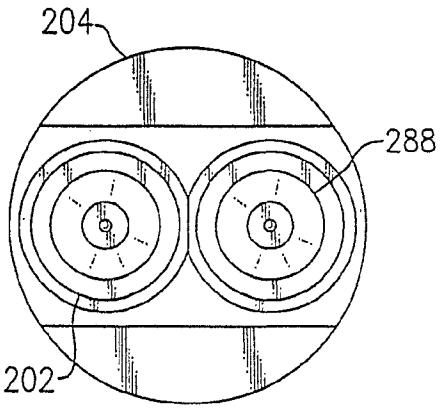
FIG. 5B is a diagrammatic front elevational view of FIG. 5A.
Figure 5A:
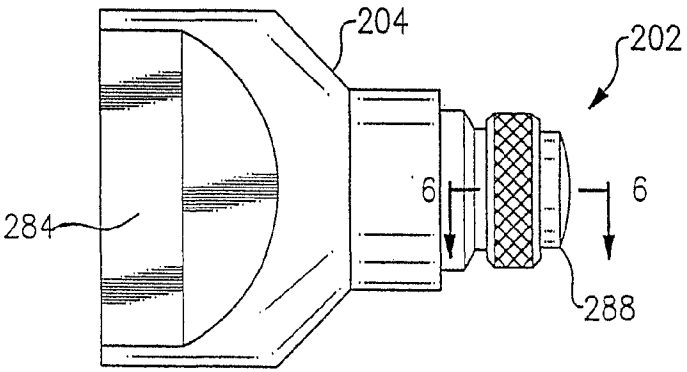
FIG. 5A is a diagrammatic side elevational view of a nozzle housing having a pair of discharge nozzles with concentric fuel and pressurized air discharge orifices.
Figure 5D:
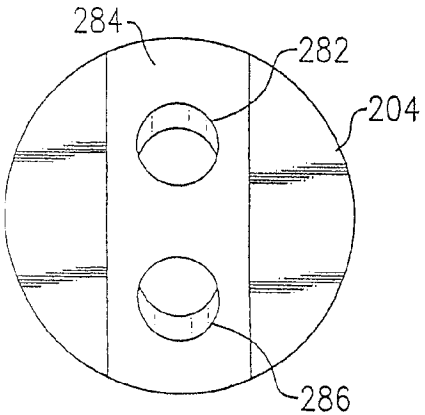
FIG. 5D is a diagrammatic rear elevation view of FIG. 5A.
Figure 6:
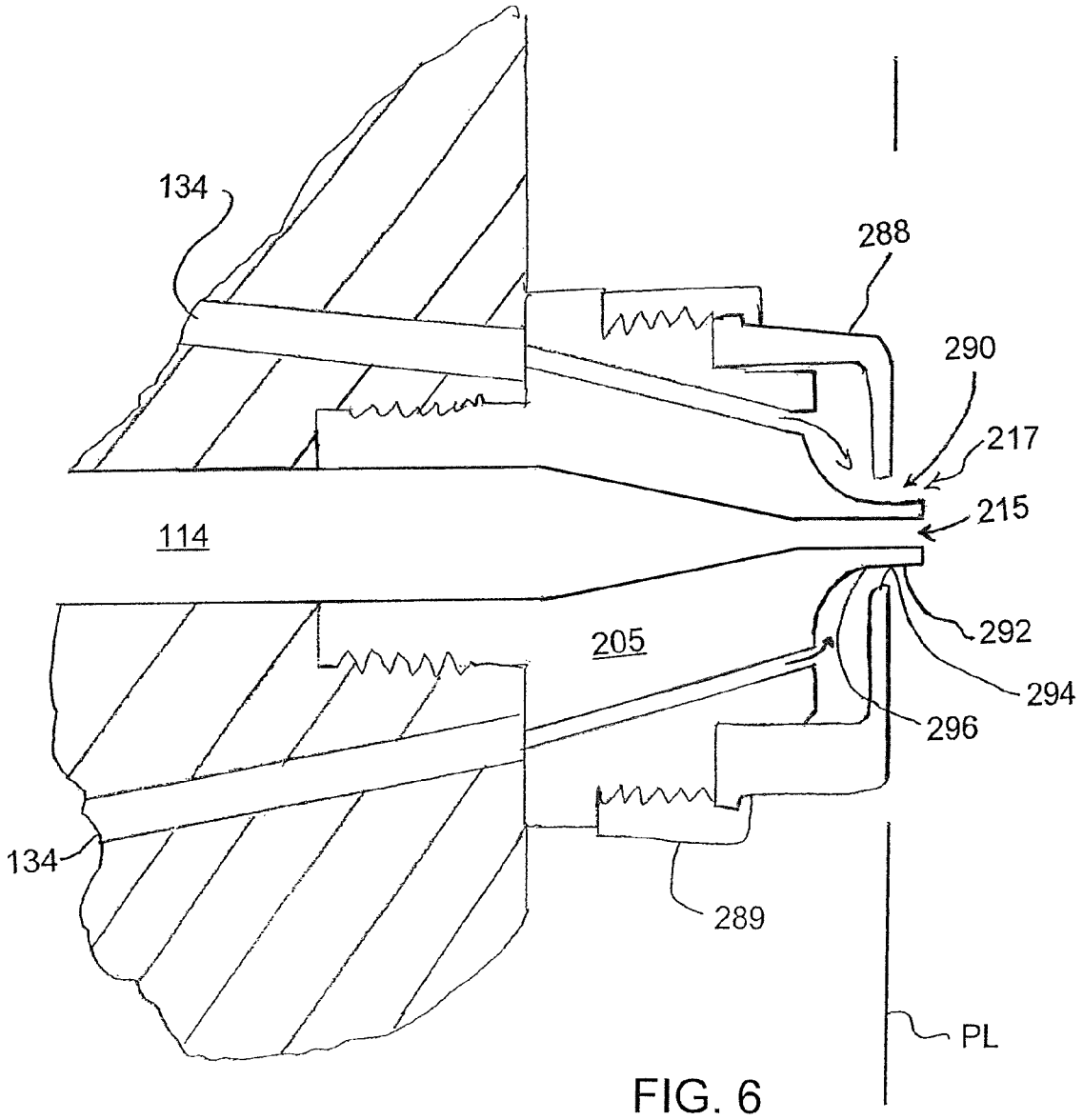
FIG. 6 is a diagrammatic cross sectional view along section line 6-6 of FIG. 5A.

Turning now to FIGS. 5A-6, a further detail description concerning the features of the one or more discharge nozzle(s) 202 will now be provided. As briefly discussed above, the liquid fuel is supplied, via the liquid fuel supply conduit 114, to a single liquid fuel inlet port 282 generally provided in a rear surface 284 of the nozzle housing 204 while the pressurized air is supplied, via the pressurized air supply conduit 134, to a single pressurized air inlet port 286 generally provided in the rear surface 284 of the nozzle housing 204. The pressurized air supply conduit 134, after entering into the discharge nozzle housing 204 through the air inlet port 286, divides into two or more separate pressurized air supply conduits 134 one for each discharge nozzle 202—and each separate supply conduit 134 communicates with a respective pressurized air orifice 217.

Similarly, the liquid fuel supply conduit 114, after entering into the discharge nozzle housing 204 via the liquid fuel inlet port 282, divides into two or more separate liquid fuel supply conduits 114—one for each discharge nozzle 202. Each separate fuel conduit communicates with a respective fuel orifice 215. The separate liquid fuel and the pressurized air supply conduits 134 both separately enter a fuel discharge nozzle 202, where the supplied liquid fuel and the supplied pressurized air are discharged though the fuel orifices 215 and pressurized air orifices 217, and thereafter only intimately mix with one another and a further discussion concerning the same is now provided.

As can be seen in FIG. 6, for example, each discharge nozzle 202 comprises a centrally located fuel orifice 215 which is concentrically surrounded by the air orifice 217. That is, for each discharge nozzle 202, a removable cover 288 engages with and closes off the discharge end of the respective discharge nozzle 202 and a threaded ring 289 engages with a mating thread of a replaceable fuel orifice housing 205 and retains the removable cover 288 in position. The replaceable fuel orifice housing 205 facilitates replacement of the size of the fuel orifice 215, e.g., to a larger or smaller orifice size, by an operator. The removable cover 288 has a relatively large opening 290 formed therein for accommodating the fuel orifice 215. The fuel orifice 215 passes through the relatively large opening 290 and the remote end thereof is open and facilitates discharge of the liquid fuel from the liquid fuel supply conduit 114. The liquid fuel flows along the liquid fuel supply conduit 114 and out through the liquid fuel orifice 215 for eventual mixing with the supplied air. The pressurized air flows along the air supply conduit 134 and into the compressed air chamber 150 which is formed by the outwardly facing surface of the replaceable fuel orifice housing 205 and the inwardly facing surface of the removable cover 288. The pressurized air eventually is discharged out through the air orifice 217 defined a cylindrical outlet section 292 of the fuel orifice 215 and an inwardly facing cylindrical surface 294 of the opening 290 formed in the removable cover 288. As a result of such arrangement, an operator can easily modify the size of the air orifices and/or fuel orifices by replacement of the fuel orifice housing 205 and the removable cover 288.

It is important to note that an exterior face of the removable cover 288 defines a plane PL which separates the pressurized or compressed air from an interior chamber of the air deflector sleeve 276 while the fuel orifice 215 extends or projects out through an opening in the removable cover 288 past this plane PL by a small distance, e.g., typically between 0.002 to about 0.020 of an inch and more preferably a distance of between about 0.003 and about 0.005 of an inch. As a result of this, both the fuel orifice 215 and the pressurized air orifice 217 discharge their respective fuel components directly into the internal chamber of the air deflector sleeve 276. That is, the liquid fuel component is directly discharged into the internal chamber defined by the air deflector sleeve 276 while the pressured air component is also separately discharged into the internal chamber defined by the air deflector sleeve 276. Only once these fuel components are discharged into the internal chamber defined by the air deflector sleeve 276 is the liquid fuel atomized into a particle size of between about 30 to 35 microns, for example, and intimately mixed with the pressurized air to form a fuel mixture 153 which is, thereafter, suitable for consumption within the furnace 154 during combustion of the fuel mixture 153. As with the previous embodiments, the pressurized air component, as this air is discharged from the pressurized air orifices 217, tends to create a vacuum which assists with withdrawing and/or evacuating the liquid fuel component from the fuel orifice 215 of the discharge nozzle 202 in addition to the pressure of supplied liquid fuel.

The pressurized or compressed air is generally discharged circumferentially about and around the perimeter of the liquid fuel orifice 215 and the discharged pressurized air, along with the withdrawn and/or evacuated liquid fuel, are each separately discharged and then intimately mixed with one another. As a result of this, the liquid fuel is substantially atomized, upon being discharged from the respective liquid fuel orifice 215, and thus is immediately able to be rapidly or substantially instantaneously consumed and burned, within the furnace 154, while maximizing the generation of heat and minimizing the consumption of fuel.

The inventors have determined that for this embodiment the relative spacing of the end face of the liquid fuel orifice 215 from the end face of the removable cover 288 is important in determining the overall characteristics of the flame as the fuel components are emitted and consumed within the furnace 154. By having the end face of the liquid fuel orifices 215 extend a small distance further into the internal chamber defined by the air deflector sleeve 276 further than the end face of the removable cover 288, such arrangement has a tendency of inducing desired atomization of the liquid fuel component while also facilitating the formation of a relatively compact and axially short flame which leads to improved combustion and minimizes the generation of any soot.

As described above, by controlling the rotational speed of the blast tube fan 142 and/or adjusting the position of the damper(s) 252 of the blast tube fan 142, which adjustably controls the sizes of the air inlet openings to the squirrel cage of the blast tube fan 142, an operator can readily control the axial and the radial dimensions of the flame burning within the furnace 154. However, the control that an operator has over the axial and the radial dimensions of the burning flame, by merely adjusting the rotational speed of the blast tube fan 142 and supplied air flow, is somewhat limited.

The axial and the radial dimensions of the burning flame can also be adjusted by number and spacing of the air and fuel orifices 215, 217 from one another, the number and spacing of the discharge nozzles from one another, the amount of supplemental air which is allowed to flow over the one or more discharge nozzle(s) 202, the flow of pressurized or compressed air through the pressurized air orifices 217, the relative spacing of the end face of the liquid fuel orifices 215 relative to the end face of the removable cover 288/the pressurized air orifices 217 as well as the other characteristics of the one or more discharge nozzle(s) 202. It is to be appreciated that the one or more discharge nozzle(s)

202 can be designed to discharge the liquid fuel in a spray pattern with a desired discharge angle (see, for example, the discussion of FIG. 8).

As discussed above, a flame detector 160 is normally positioned upstream of the ignition electrode(s) 156 and suitably located for viewing and detecting the presence of a flame, in the area immediately in front of the one or more discharge orifice 202, to confirm whether or not a flame is present within the furnace 154. In the event that the flame detector 160 does not detect a flame, a lack of flame signal is then supplied, in a conventional manner, to the control unit which then interrupts the flow of liquid fuel and/or compressed air to the one or more discharge nozzle(s) 202 and then again initiates ignition of the flame, in a conventional manner. However, in the event that the flame detector 160 does, in fact, detect the presence of a flame resulting from the combustion of the fuel mixture 153, then such presence is also conveyed to the control unit 212 which continues operation of the combustion system until a sufficient amount of heat has been generated.

Figure 7:
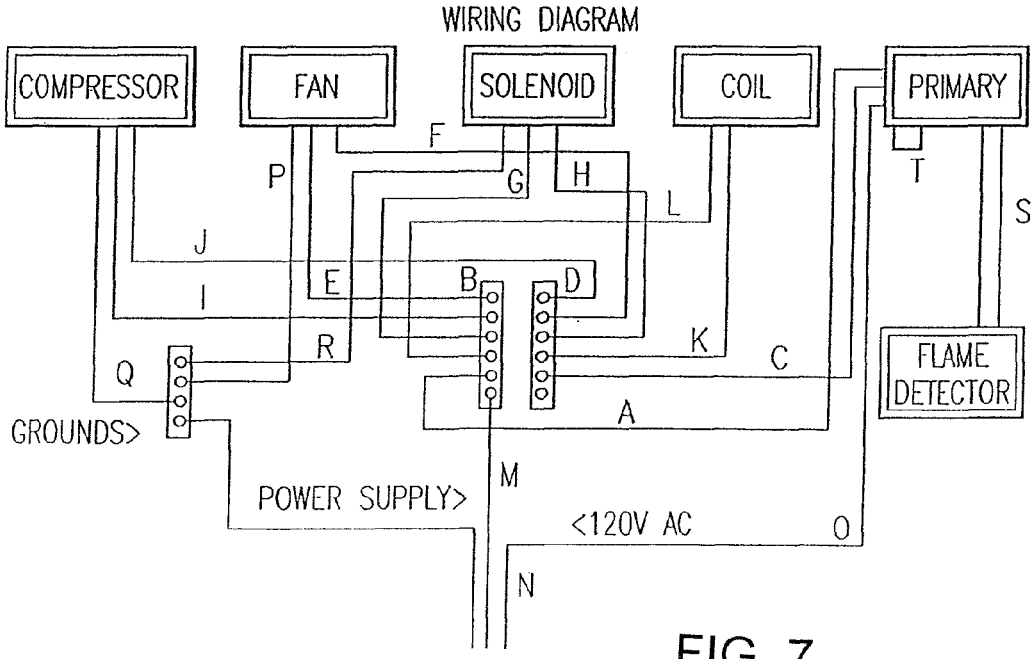
FIG. 7 is a diagrammatic wiring diagram of an embodiment of the present invention.

The following is very brief description of the wiring diagram shown in FIG. 7 of the drawings.

Line A extends between Fuel Primary and a Hot Bus Bar B;

Hot Bus Bar B;

Line C extends between Fuel Primary and a Neutral Bus Bar D;

Neutral Bus Bar D;

Line E extends between Supplemental air fan and Hot Bus Bar B;

Line F extends between Supplemental air fan and Neutral Bus Bar D;

Line G extends between Solenoid and Hot Bus Bar B;

Line H extends between Solenoid and Neutral Bus Bar D;

Line extends between Compressor and Hot Bus Bar B;

Line J extends between Compressor and Neutral Bus Bar D;

Line K extends between Coil and Neutral Bus Bar D;

Line L extends between Coil and Hot Bus Bar B;

Line M extends between Power Supply and Hot Bus Bar B;

Line N extends between Power Supply and Fuel Primary;

Line O extends between Power Supply and Fuel Primary;

Line P extends between Supplemental air fan and Ground Bus Bar;

Line Q extends between Compressor and Ground Bus Bar;

Line R extends between Solenoid and Ground Bus Bar;

Line S extends between Fuel Primary and Flame Detector; and

Line T extends between Fuel Primary and Float Switch/Valve.

As illustrated in FIG. 8, the shape of the fuel discharge pattern, from each of the nozzles, is relatively short and fat. That is, the shape of the resulting flame BF is generally axially shorter and wider radially than the shape of the flame from a single discharge nozzle with a single concentric fuel orifice 215 and air orifice 217. The discharge angle A1 of FIG. 8, using discharge nozzle(s) 202, each with a concentric fuel orifice 215 and an air orifice 217, typically ranges from between 15 to about 65 degrees and more preferably between 20 and 55 degrees. The spray pattern, and thus the flame generally has an axial length L1 of between 6 inches and 18 inches or preferably between about 8 inches and about 12 inches and has a radial spread R1 of between 5 inches and about 10 inches more preferably between about 6 inches to about 8 inches.

It has been found that an axially shorter and radially wider flame, generated by the discharge nozzle(s) 202, shown in FIGS. 5A-5D for example, thereby increases the overall efficiency of the fuel mixture 153 being consumed within the furnace 154. It is believed that the shorter, wider, more compact flame thereby results in substantially complete combustion of the fuel, e.g., substantially all of the BTUs contained within the fuel mixture 153 are extracted and given off from the fuel mixture 153, and this thereby results in more efficient heating of the heat transfer element(s) of the heating system.

Figure 9:
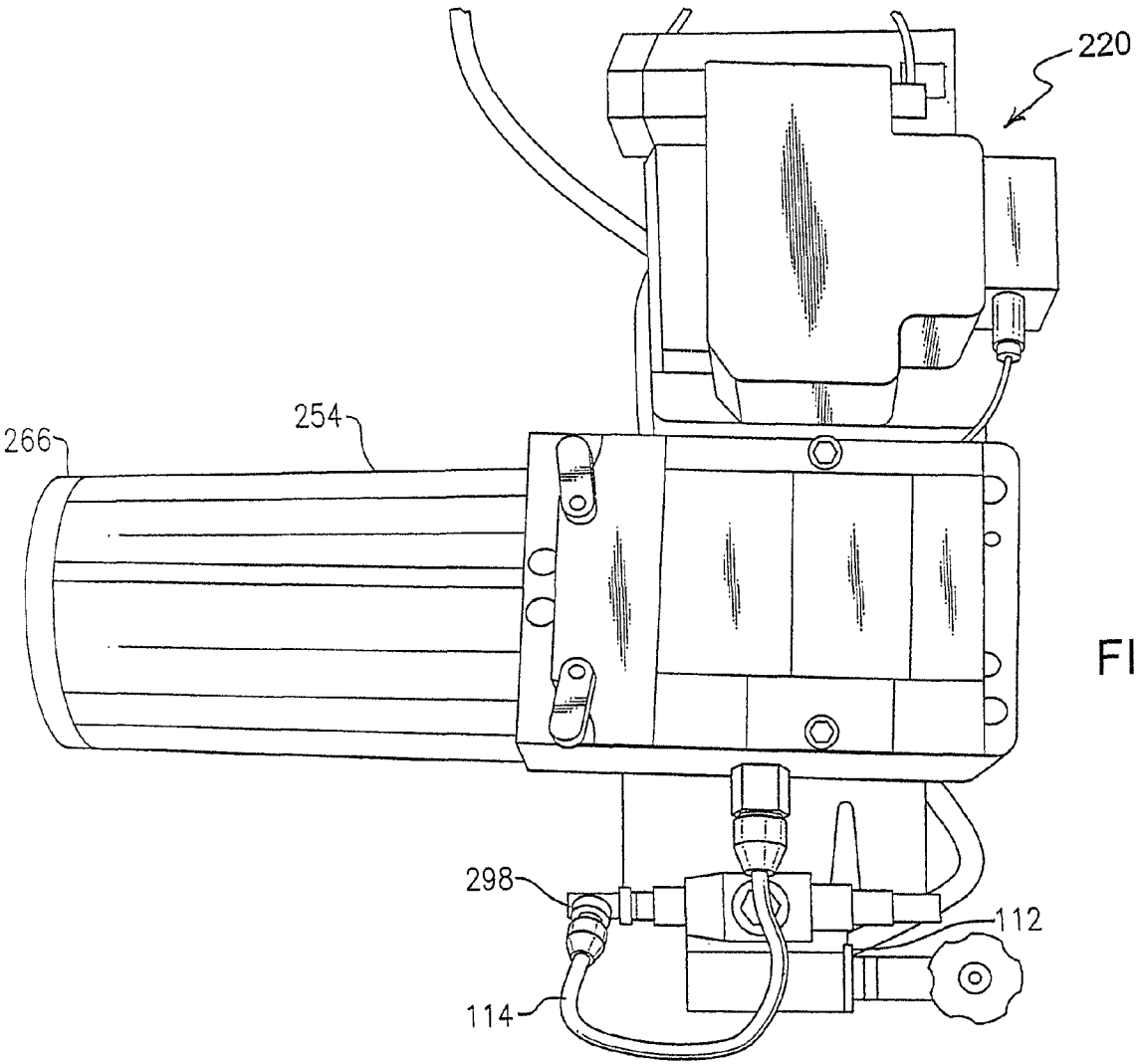
FIG. 9 is a diagrammatic view showing a further embodiment of the invention.

Turning now to FIGS. 9-11, a description concerning a third embodiment of the fuel combustion system 2, according to the present invention, will now be described in detail. As this embodiment is somewhat similar to the previously described embodiments, only the differences between this embodiment and the previously described embodiments will now be described in detail.

As generally shown in FIG. 9, the liquid fuel, pumped by the fuel pump 112, is directly pumped to the nozzle housing 204 (not shown) to supply fuel to each of the fuel orifices 215. In addition, a manually adjustable/replaceable fuel restrictor/regulator 298 is provided along this direct liquid fuel supply conduit 114.

As shown in FIG. 9, the fuel regulator 298 is located downstream the pump 112, typically adjacent thereto, for adjusting the flow rate and/or the pressure of the liquid fuel being supplied by the pump 112 to the respective liquid fuel orifice 215 of each of the discharge nozzles 202. In addition, the air compressor 220 is affixed directly to the burner, on a side thereof opposite to the pump 114, for supplying compressed air to the two discharge nozzles 202. This arrangement renders the fuel combustion system more compact. In all other respects, this embodiment is substantially similar or identical to the previously discussed embodiment and thus a further discussion concerning the same is not provided.

The pressurized air is preferably supplied by an air compressor 220, such as a Thomas Products Division air compression headquartered in Sheboygan, Wis. and sold as part number 918CA15. This compressor can provide a compressed air flow rate of between 150±75 cubic fee per minute. The air compressor typically supplies compressed air at a pressure of between 2 and 30 psi, for example, and the supplied compressed air, after passing through the air restrictor 248, is typically reduced to a pressure of between about 3.5 psi and 7.0 psi, more preferably to a pressure of about 6.0 psi or so, depending upon the overall requirements of the combustion system.

According to this embodiment, the end face of the flame retention head 266, which directly communicates with the burner box located within the furnace 154, is not provided with any air outlet therein, e.g., the end face is a solid wall or surface. As a result of this, the end face of the flame retention head 266 functions as a stop surface which prevents any air from flowing directly through the end face thereof. Accordingly, the end face redirects and diverts the supplied supplemental airflow generally radially inwardly toward the dispensed fuel mixture 153 via three possible supplemental air flow paths (discussed below in further detail) before the supplemental air is eventually permitted to flow out of the blast tube 254 and into the furnace 154.

As generally shown in FIG. 10A-D, a generally cylindrical air deflector sleeve 276 is completely accommodated within the blast tube 254. Both the inlet end 259 and the outlet end 257 of the air deflector sleeve 276 are generally circular in shape. A diameter of the air deflector sleeve 276, commencing at the inlet end 259 thereof, slowly and gradually increases in diameter along a first half of the air deflector sleeve 276 (i.e., the inlet section 278), until an axial mid section 277 of the air deflector sleeve 276. Thereafter, a diameter of the air deflector sleeve 276 slowly and gradually decreases in diameter along a second half of the air deflector sleeve 276 (i.e., the outlet section 279), until reaching the outlet end 257 of the air deflector sleeve 276. As a result, the diameter of the mid-section 277 of the air deflector sleeve 276 is greater than the diameter of either the inlet end 259 or the outlet end 257 of the air deflector sleeve 276. The portion of the air deflector sleeve 276, from the inlet end 259 of the air deflector sleeve 276 to the axial mid section 277, forms the inlet section 278. Likewise, the portion of the air deflector sleeve 276, from the mid-section 277 of the air deflector sleeve 276 to the outlet end 257, forms an outlet section 279. As a result of such arrangement, the larger diameter mid-section 277 is formed between the inlet end 259 and the outlet end 257 of the air deflector sleeve 276. Preferably, both the inlet section 278 and the outlet section 279 are partially curved or spherical in shape.

FIGS. 10A, 10B and 10D also illustrates additional features which may comprise part of the air deflector sleeve 276. For example, the air deflector sleeve 276 include a bottom alignment/air deflector plate 356, a circumferential air deflector plate 358, and possibly a top air deflector plate 354. Each one of these plates is located adjacent the inlet end 259 of the air deflector sleeve 276. During a typical installation, the bottom alignment/air deflector plate 356 will normally abut against, or be located closely adjacent to, the nozzle housing 204 and assists with adequately aligning and spacing the inlet end 259 of the air deflector sleeve 276 from the nozzle housing 204 so that a small gap 280 is formed between the inlet section 278 and the nozzle housing 204 while the two discharge nozzle(s) 202 are accommodated within the internal chamber defined by the inlet section 278 of the air deflector sleeve 276. In addition, the circumferential air deflector plate 358 extends partially circumferentially around the bottom half of the inlet section 278 of the air deflector sleeve 276. The circumferential air deflector plate 358 has a plurality of side vents or ports 359, e.g., between 3 and 15 vents or ports 359 and more preferably about 10 vents or ports 359, formed therein and each one of the vent(s) or port(s) 359 a diameter between the 1/16 and 3/8 of an inch, for example. These side vents or ports 359 permit supplemental air to flow into the inlet end 259 of the air deflector sleeve 276.

The top air deflector plate 354, if provided, forms a supplemental air flow obstruction which redirects and prevents some of the supplemental air from flowing into the inlet end 259 of the air deflector sleeve 276. That is, the top air deflector plate 354 assists with diverting and channeling some of the supplemental air along the exterior surface of the air deflector sleeve 276 and toward the flame retention head 266.

An axially extending cylindrical surface 269 is integral with a radially inner perimeter circumferential edge of the end face of the flame retention head 266. This cylindrical surface 269 has a length of about 1/2 to 3/4 of an inch or so, for example. Six apertures 271 are formed within the cylindrical surface 269 and each of the six apertures 271 extends completely through the cylindrical surface 269. The six apertures 271 are generally equally spaced from one another about the circumference of the cylindrical surface 269. Each one of the six apertures 271 has a diameter of between about 1/8 to 3/8 of an inch for example, and more preferably have a diameter of about a quarter of an inch or so. Due to this arrangement, some of the supplemental air, which flows between the air deflector sleeve 276 and the blast tube 254, is diverted and redirected by the end face of the flame retention head 266 radially inward toward these six apertures 271 and such redirected flow helps shape the flame BF. These six apertures 271 combine with one another and form a first head flow path P1 for the supplemental air. It is to be appreciated that the number of the apertures 271 and/or the size of the apertures 271, provided in the cylindrical surface 269, can be varied, from application to application, without departing from the spirit and scope of the present invention.

The cylindrical surface 269 is located adjacent the outlet end 257 of the flame retention head 266 and is formed integral with a stepped section 273 and a conically tapered section 275. The conical tapered section 275 generally comprises a conical surface which gradually tapers, e.g., decreases in diameter, from a largest diameter located facing toward the furnace and smaller diameter located facing toward the air deflector sleeve 276.

The outlet end 257 of the air deflector sleeve 276 has a diameter which is slightly smaller in diameter than a smallest diameter of the conical tapered section 275 of the flame retention head 266. As a result, when the outlet end 257 of the air deflector sleeve 276 is affixed or otherwise permanently secured to the conical tapered section 275 of the flame retention head 266, e.g., by tack welding for example, a small circumferential passageway is formed between the exterior surface of the outlet end 257 of the air deflector sleeve 276 and the inwardly facing surface of the conical tapered section 275 of the flame retention head 266. This small circumferential passageway P2 forms a second passageway flow path which allows some of the supplemental air to flow through the small circumferential passageway P2 and directly into the furnace 154 and thereby assist with substantially complete combustion of the fuel mixture 153.

As with the previous embodiment, (see for example, FIG. 2B), the air deflector sleeve 276 is arranged within the blast tube 254 and is generally concentric with respect to the blast tube 254. The inlet section 278 of the air deflector sleeve 276 generally communicates with the nozzle housing 204, or possibly the support plate 260 which separates the blast tube 254 from the various burner components, e.g., the ignition components, the liquid fuel supply conduit 114 and the compressed air supply conduit 134 (not shown).

As shown in FIGS. 10A-10E, the inlet section 278 generally comprises a first solid generally spherical surface which does not contain any perforations, opening or apertures therein while the outlet section 279 includes a plurality of its spaced apart apertures 350 formed therein, e.g., the outlet section 279 generally comprises a perforated surface which has a plurality of equally spaced perforations, apertures or openings 350 formed therein, e.g., between 15 and 100 or so perforations, apertures or openings 350 and more preferably about 45 generally equally spaced perforations, apertures or openings 350. Each one of the perforation, aperture or opening 350 is approximately a 1/4 inch in diameter±1/8 of inch and extends completely through the surface of the outlet section 279. The perforations, apertures or openings 350, formed in the outlet section 279, form a third outlet section flow path P3 for the supplemental air which further shapes and assists with complete combustion of the fuel mixture 153.

It will be appreciated to those skilled in the art that the perforations, apertures or openings 350 may be arranged, if desired, to impart a swirling motion to air flowing therethrough. It will also be appreciated, however, that the number, the size, the spacing, and the location of these plurality of perforations, apertures or openings 350 can vary, from application to application, depending upon the particular requirements of the fuel combustion system without departing from the spirit and scope of the presently claimed invention.

In the embodiment present in FIG. 10A-D, the annular gap 280 is formed due the slightly larger diameter than the nozzle housing 204 so that the inlet section 278 of the air deflector sleeve 276 extends over and partially surround a portion of the nozzle housing 204 and forms the annular gap 280 therebetween. It is to be appreciated that the inlet section 278 of the air deflector sleeve 276, alternatively, may have a smaller diameter than the nozzle housing 204 and be located closest adjacent thereto so as to form the annular gap 280 therebetween. Further, it is to be appreciated that the inlet section 278 of the air deflector sleeve 276 may have a diameter that is equal to the nozzle housing 204 so that the annular gap 280 is formed by adequately spacing the inlet section 278 from the nozzle housing 204.

This annular gap 280, between either the nozzle housing 204 and the inlet section 278 of the air deflector sleeve 276, provides a small annular opening through which some of the supplemental air, supplied by the blast tube fan 142, is permitted to flow through and be supplied directly to the discharge nozzles 202. The supplemental air, which flows in through this annular gap 280, is useful in supplying supplemental air to the discharge nozzles 202 and also assists with cooling the discharge nozzles 202 and thereby maintain the discharge nozzles 202 at a relatively low operating temperature.

The air deflector sleeve 276 typically has an axial length of two and one half to five inches. As noted above, typically the outlet end 257 of the air deflector sleeve 276 is connected with the flame retention head 266. The air deflector sleeve 276 is completely enclosed and accommodated within the blast tube 254, and the diameters of the mid-section, the outlet and inlet sections 277, 278 and 279 each have diameters which are smaller than the internal diameter of the blast tube 254.

As noted above, the flame retention head 266 prevents any supplemental air from flowing directly axially through the end face thereof. That is, all of the supplemental air, which flows between the inwardly facing surface of the blast tube 254 and the exterior surface of the air deflector sleeve 276 toward the flame retention head 266 is confined therebetween and eventually redirected by the flame retention head 266 since none of the supplemental air is permitted to flow through the end face of the flame retention head 266. As a result, the supplied supplemental air is redirected and diverted, by the end face of the flame retention head 266, along one of three possible flow paths P1, P2 or P3. The first head flow path P1 is through the six (6) equally spaced holes formed in the radially inward facing cylindrical surface 269 of the flame retention head 266. The second passageway flow path P2 is along the small circumferential passageway P2 formed between the flame retention head 266 and the outlet end 257 of the air deflector sleeve 276. The third outlet section flow path P3 is through the plurality of holes 350 formed within the outlet section 278 of the air deflector sleeve 276. As with the previous embodiment, one or more of these three supplemental air flow paths can be designed to induce a swirling or spinning action of the fuel mixture 153.

Due to this arrangement, a majority of the air supplied by the blast tube fan 142 passes between the exterior surface of the air deflector sleeve 276 and inwardly facing surface of the blast tube 254 and eventually flows toward the flame retention head 266 but is prevented from being discharged or exhausted out through the end face of the flame retention head 266. That is, typically between about 90% to about 97% of the supplemental air is redirected by the nozzle housing 204 and flows along the exterior surface of the air deflector sleeve 276 toward the flame retention head 266 while only between about 3% and 10% of the supplied air is permitted to flow through the annular gap 280 formed between either the nozzle housing 204 and the inlet section 278 of the air deflector sleeve 276 and/or through the small holes 359 formed in the circumferential air deflector plate 358. The supplemental air, which flows through the annular gap 280 and/or through the small holes 359 assists with cooling the one or more discharge nozzles 202 and possibly inducing a swirling or spinning rotation or motion of the supplemental air. Such swirling or spinning supplemental air assists with centering the flame BF within the furnace 154.

It is important to control the amount of supplemental air which flows through the annular gap 280 and directly communicates with the discharge nozzles 202. During operation of the burner, it is desirable to maintain the flame BF as close as possible to, but slightly spaced from, the one or more discharge nozzles 202, e.g., the flame BF is typically spaced about a quarter of an inch or so away from the discharge nozzles 202. Such spacing of the flame BF, from the discharge nozzles 202 generally, results in the creation of an efficient flame, e.g., a blue flame, while also preventing the discharge nozzles 202 from becoming fouled and/or overheated during operation of the fuel combustion system.

As shown in those figures, the air deflector sleeve 276 is accommodated within the cylindrical blast tube 254, and has a diameter of between about 1¾ inches and 5 inches. In addition, the air deflector sleeve 276 generally has an axial length of between about 3 inches and 10 inches, and more preferably about 4 to 5 inches. The air deflector sleeve 276 has a largest diameter mid-section 277 which is located between the tapered inlet and outlet sections 279, 278 thereof. The mid-section 277 generally has a diameter of between 2 inches to 6 inches, and more preferably has a diameter of about 3 inches. Typically, the diameter of the mid-section 277 is approximately 15-50% greater than the diameter of the inlet and/or the outlet ends 259, 257 of the air deflector sleeve 276.

As noted above, since the flame retention head 266 is not provided with any air flow outlets and thereby forms an annular stop wall or surface. Accordingly, all of the supplemental air is generally forced radially inwardly through the apertures 271 formed in the cylindrical surface 269, the small circumferential passageway P2 or the plurality of perforations, apertures or openings 350 formed in the outlet section 278 of the air deflector sleeve 276. These three air flows have a tendency to increase the pressure within the cylindrical section which, in turn, has a tendency to shorten the length and condensed the flame BF which thereby results in improved combustion of all of the fuel and thereby results in a much higher temperature, e.g., a temperature of between 2,000° F. and 2,600° F., for example.

As illustrated in FIG. 10D, the inlet section 278 has a diameter of about 2¼ inch. The internal air deflector plate 358 has a width of about 1⅜ inch and a height of about ½ inch. The top air deflector plate 354 has a width of about 1 9/16 inch. FIG. 10D also illustrates the top air deflector plate 354 as having a slight curvature which is curved in an opposite direction to the curvature of the air deflector sleeve 276. The bottom air deflector plate 356 is generally flat. Whereas, the internal air deflector plate 358 has a curvature which is equal to the curvature of the edge of the inlet section 278. While these curvatures have been found to provide improved air flow as the supplement air is introduced via the annular gap 280, different curvatures are possibly and may be utilized in order to support the desired air flow and motion.

As with the previous embodiments, the inlet section 278 of the air deflector sleeve 276 surrounds and encases the discharge nozzles 202. The discharge nozzles 202 are located within the internal chamber of the air deflector sleeve 276 so as to discharge the fuel along a central axis of the fuel combustion system. It is to be appreciated that the overall size, shape and configuration of the cylindrical blast tube 254 and the air deflector sleeve 276 may vary, depending upon the particular application, but the dimensions are generally designed so as to induce sufficient air flow from the inlet end 259 of the air deflector sleeve 276 to the opposed outlet end 257 thereof. Preferably a speed of the fan or the blower is adjustable in order to regulate the velocity of the supplemental air being forced or directed through the cylindrical blast tube 254, e.g., at a flow rate of between 5 feet per second to about 100 feet per second or so, for example. The air deflector sleeve 276 restricts the combustion of the fuel mixture 153 along the axis of the fuel combustion system 2 so as prevent the cylindrical blast tube 254 from becoming excessively hot during the combustion process.

Figure 21:
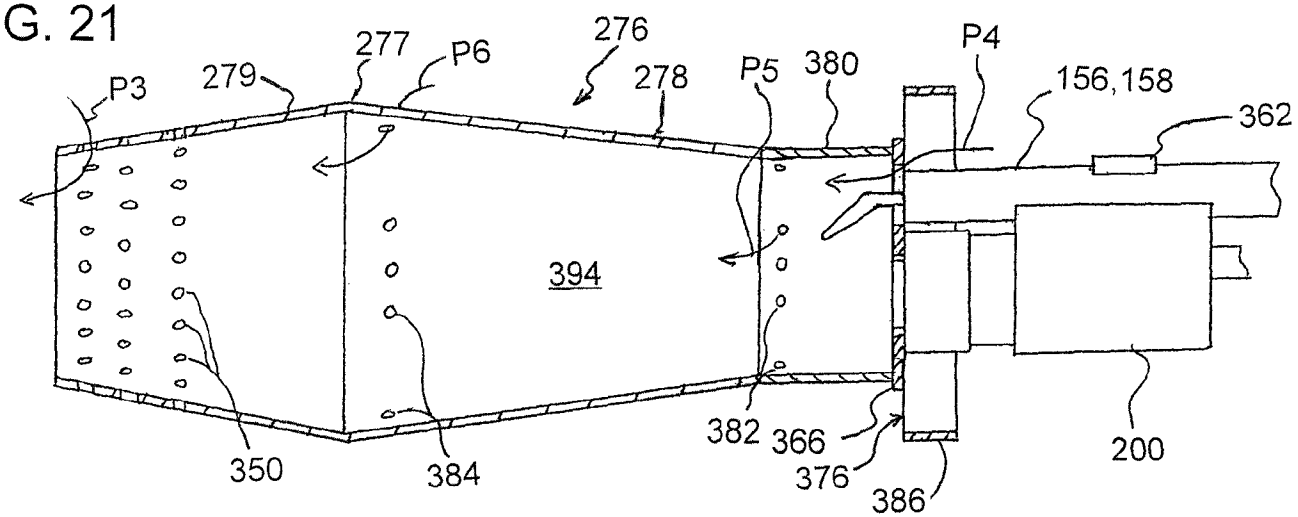
FIG. 21 is diagrammatic cross sectional view of FIG. 20.

FIGS. 11A-11E are diagrammatic views of a suitable fuel regulator 298. As shown in FIG. 21, the fuel regulator 298 is provided along the flow path of the fuel supply conduit 114 to ensure that the flow is supplied to the nozzles at a consistent flow rate and pressure. The fuel regulator 298 facilitates the flow of fuel at the desired constant pressure and volume and this results in a more uniform flame BF which has less of a tendency to fluctuate due to fuel flow rate variations. It is to be appreciated that an orifice, or any other type of device which adequately restricts the flow rate of the fuel while still providing a desired fuel flow rate of the fuel supplied to the nozzles, may be substituted in place thereof.

Typically, the preferred fuel regulator 298 comprises a regulator housing 402 and a regulator nozzle 404 which is typically sized to fit within a respective elbow 406. As illustrated diagrammatically in FIG. 11A, the regulator nozzle 404 has a length of about 9/16 of an inch and the regulator housing 402 has a length of about 1 7/16 inches. The regulator housing 402 has a length of about ¾ of an inch.

Figure 11A:
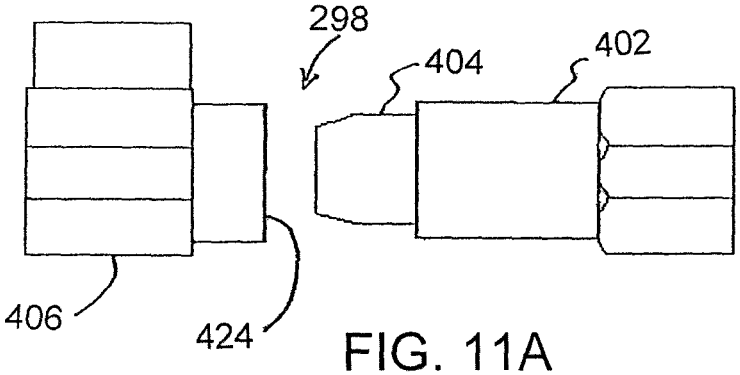
FIG. 11A is a diagrammatic view of a fuel regulator and elbow prior to assembly.
Figure 11B:
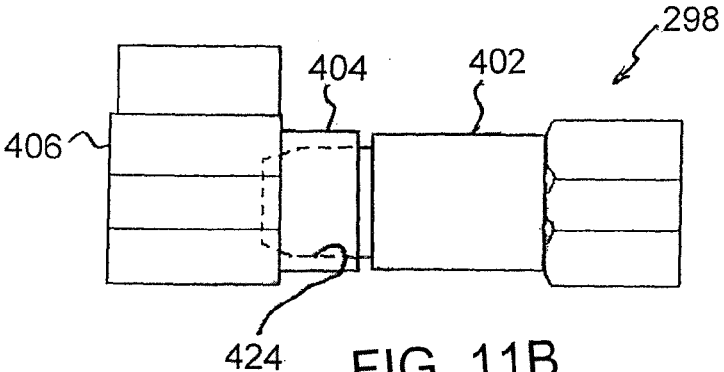
FIG. 11B is a diagrammatic view of the fuel regulator and elbow following assembly with one another.
Figure 11C:
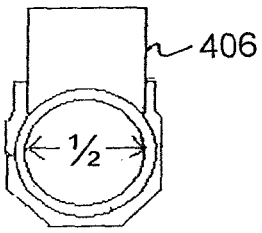
FIG. 11C is a diagrammatic front view of the elbow.

In FIGS. 11A, 11B and 11C, the elbow 406 is diagrammatically illustrated as hollow and typically having a first end with a first opening 424 for encompassing the nozzle 404 of the fuel regulator 298 and a second end has a second opening. The first opening 424 of the elbow 406 has an internal diameter of between about ⅛ inch to about 1 inch. In FIG. 11C, an embodiment is shown where the first opening 424 of the elbow 406 has an internal diameter of about 9/16 inch.

Figure 11D:
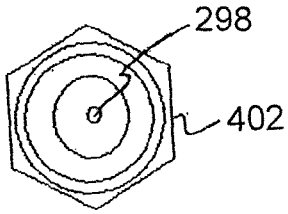
FIG. 11D is a diagrammatic front view of the fuel regulator.

In FIG. 11D, a front view (facing towards the elbow 406) of the fuel regulator 298 shows the nested sections of the fuel regulator with various diameters. The front orifice 412 of the regulator nozzle 404 has an internal diameter of about 1/32 of an inch. The inlet circumference 414 of the regulator nozzle 404 having a diameter of about 6/16 of an inch and the outlet circumference having a diameter of about ⅝ of an inch. The elongate portion of the regulator housing has a circumference 418 with an external diameter of about ⅝ inch. The corrugated portion 410 of the regulator housing has a shorter width 420 of about ¾ inch and a longer width 422 of about ⅞ inch.

Figure 11E:
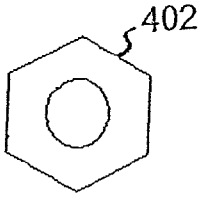
FIG. 11E is a diagrammatic rear view of the fuel regulator of FIG. 11A.

In FIG. 11E, a rear view (facing away from the elbow 406) of the fuel regulator 298 shows a rear external orifice 424 of the fuel regulator having an internal diameter of about 5/16 inch, and the widths 420, 422 of the regulator housing 402 are unchanged from the front view as shown in FIG. 11D.

In the event that a fuel combustion system, according to the present invention, replaces an old existing burner, generally the old existing burner will first be in the furnace in a conventional manner and then the new fuel combustion system, according to the present invention, will be installed in place thereof in a conventional manner. Thereafter, the operator will, once all the components are properly hooked up to the new fuel combustion system in a conventional manner, start the burner and measure the stacked temperature of the exhaust fumes exhausting up the flue. If the stack temperature is too low, the operator will then increase the fuel flow rate (e.g., replace the fuel regulator 298 so as to increase the flow rate therethrough or possibly increase the size of the liquid fuel orifices 215) so that additional fuel is conveyed into the furnace 154 for combustion. This will generally increase the combustion temperature of the furnace 154 as well as the temperature of the exhaust fumes exhausting from the furnace 154 through the flue.

In the event that the tip of the flame BF reaches and contacts the opposite rear wall of the furnace 154 (this is typically checked by a visual inspection of the furnace 154), the operator will then reduce the flow rate of the pressurized or compressed air. The operator may choose to decrease the pressure of the supplied pressurized or compressed air, decrease the opening size in the removable cover 288 (see FIGS. 5A-5D) and/or decrease the size of the air restrictor 248. This assists with withdrawing the fuel out of the liquid fuel orifice 215, and this typically shortens or decreases the overall axial length of the flame BF and thereby assists with adequately spacing the tip of the flame BF away from the opposed rear wall of the furnace 154.

Alternatively, if the stack temperature is too high, the operator will decrease the fuel flow rate (e.g., decrease the pressure and/or flow rate of the liquid fuel, replace the fuel regulator 298 so as to reduce the flow rate therethrough or possibly decrease the size of the liquid fuel orifices 215) and adjust the flow rate of the pressurized or compressed air (e.g., either increase or decrease the pressure of the supplied pressurized or compressed air, either increase or decrease the pressurized or compressed air orifices 217 and/or increase or decrease the size of the air restrictor 248) so that the flame BF remains adequately spaced from the opposed rear wall of the furnace 154, e.g., the flame BF is adequately spaced therefrom by about an inch or so.

In the event that this stack temperature is still either too high or too low, the operator will again repeat one of the above processes until the measured stack temperature is at or within a recommended stack temperature range suggested by the manufacture of the furnace 154, e.g., typically the stack temperature is generally about 300±100 degrees above the temperature of a room accommodating the fuel combustion system. That is, if the fuel combustion system is located in the basement of a facility which is at a temperature of 60° F., for example, then the desired stack temperature is normally about 360° F. or so ±100 degrees.

It is to be appreciated that in the event that the tip of the flame BF reaches the opposed rear wall of the burner, this generally results in soot being created or formed on the opposed rear wall of the furnace 154 and such soot has a tendency of decreasing the overall efficiency of the fuel being consumed within the furnace 154. In addition, the generation of soot within the furnace 154 tends to form a thin layer or film on the inner wall(s) of the furnace 154 which generally hinders heat transfer from the furnace 154 to the heating system for the building. Accordingly, the fuel mixture 153 is discharged and consumed within the furnace 154 and the flame BF is correspondingly adjusted so as to (1) avoid the creation of any soot, (2) maximize combustion of the fuel mixture 153, and (3) minimizing the creation of any carbon monoxide (CO) during combustion.

It is to be appreciated that a "blue flame" is the hottest and most efficient flame, a "white flame" is generally a fairly clean and efficient flame, while a "yellow flame" is generally the most inefficient flame and is generally to be avoided, if possible. Typically, such an inefficient flame BF results from supplying excessive fuel to the furnace 154. The preferred flame BF is a blue flame which has a temperature generally between 1,800 and 2,400° F., typically between 2,100 to 2,200° F. When a blue flame is present in the furnace 154, the exhaust gases flowing up the flue from the furnace 154 typically have a carbon monoxide (CO) content less than 0.01 parts per million (ppm) and more preferably a carbon monoxide (CO) content approaching 0.00 ppm and a carbon dioxide ($CO_2$) content of at least about 8 to 9.5 ppm and more preferably a carbon dioxide ($CO_2$) content approaching between about 14.3 and about 14.8 ppm.

Following adjustment of the stack temperature as described above, the operator will then adjust the air flow rate of the supplemental air being supplied by the blast tube fan 142 to the burner. This is done by monitoring the carbon monoxide (CO) content in the exhaust gases being emitted from the furnace 154 and flowing through the flue. According to the present invention, as noted above, the desired carbon monoxide (CO) content is approaching 0.00 ppm and the rotational speed of the blast tube fan 142 and/or the damper(s) 252 of the blast tube fan 142 are controlled so as to maximize the amount of carbon dioxide ($CO_2$) being exhausted from the furnace 154 as well as, at the same time, minimize the amount of carbon monoxide (CO) which is created during combustion of the fuel mixture 153 in the furnace 154. It is to be appreciated that the burner typically needs additional supplementary air to facilitate substantially complete combustion of all of the supplied fuel. However, if excessive supplemental air is supplied to the furnace 154, this additional air has a tendency to result in incomplete combustion of the fuel contained within the furnace 154 and such incomplete combustion results in an increased amount of carbon monoxide (CO) emitted from the furnace 154 which, as noted above, is to be avoided. To compensate for excess supplemental air being supplied to the furnace 154, the operator will adjust the damper(s) 252 to decrease the amount of supplemental air being feed to the blast tube fan 142. This decrease in the supplemental air flow rate tends to allow the fuel mixture and air to "dwell" within the furnace 154 for a slightly longer duration of time, thereby promoting a more complete combustion of the fuel components while, at the same time, minimizing the amount of carbon monoxide (CO) generated during combustion.

It is to be appreciated that in order for the furnace 154 to operate properly, the furnace 154 should operate at a slight positive pressure, e.g., a positive pressure of about 0.04 psi to 0.06 psi, for example. As a result of such slight positive pressure, there is a natural draft or flow of the consumed fuel mixture 153 components, from the furnace 154 into the flue, and this further assists with substantially complete combustion of all of the liquid fuel and the air.

Each of the one or more discharge nozzles 202 is preferably a replaceable spray nozzle in which the size of the liquid fuel orifices 215 and/or the pressurized air orifices 217 can be readily adjusted or modified as desired. For example, an External Mix XA Assembly automatic spray nozzle manufactured by BETE Fog Nozzle, Inc. of Greenfield, Mass. 01301 USA which is conventionally used to atomize a fluid, e.g., water or foam, to be emitted from a sprinkler system. The inventors have determined that such external mix automatic spray nozzle may be utilized within the present invention when such spray nozzle adequately mixes a liquid fuel component with an ample supply of supplemental air (such as the pressurized or compressed air) which, in turn, atomizes the liquid fuel upon discharged from the one or more discharge nozzle(s) 202.

The fuel orifices 215 and the air orifices 217, for both the liquid fuel component and the pressurized air component, are generally quite small and provide the desired atomization of the fuel mixture 153 but can be modified, as desired, depending upon the particular application. For example, the fuel orifice 215 may have a diameter of 0.0016 of an inch (if a FC7 Liquid Cap is utilized); may have a diameter of 0.0026 of an inch (if a FC4 Liquid Cap is utilized); or may have a diameter of 0.0028 of an inch (if a FC3 Liquid Cap is utilized). Meanwhile the air orifice 217 is defined by the annular spacing between the opening 290 in the removable cover 288 and may have a radial width of preferably greater than about 0.0014 of an inch and more preferably about 0.0070 of an inch.

Illustrated in FIGS. 12-15 is a further embodiment of the air deflector sleeve 276 in combination with the fuel discharge head 200 which, in this case, supports a pair of spaced apart discharge nozzles 202 which is connected to be supplied with fuel and pressurized air and discharge the fuel mixture 153, as described above. In addition, a pair of conventional electrodes (igniters) 156, 158 which facilitate ignition of the fuel mixture 153 are supported by the exterior surface of the fuel discharge body or head 200. Each electrode (igniter) 156, 158 has an associated ignition tip located closely adjacent the outlet of a respective one of the discharge nozzles 202. The electrodes (igniters) 156, 158 are fixed to the fuel discharge body or head 200 relative to the discharge nozzles 202 by way of an electrode retainer 362. Each opposite end of the electrode retainer 362 is slightly curved so as to follow and closely conform to the exterior contour of the body of igniters 156, 158 and maximize contact therewith. A center portion of the electrode retainer 362 is secured to the fuel discharge body or head 200 by a conventional bolt or screw 364 that passes through a hole (not labeled) in the electrode retainer 362 and mates with a corresponding threaded aperture (not shown) formed in the fuel discharge body or head 200 for securing the electrodes (igniters) 156, 158 to the fuel discharge body or head 200.

Figure 12:
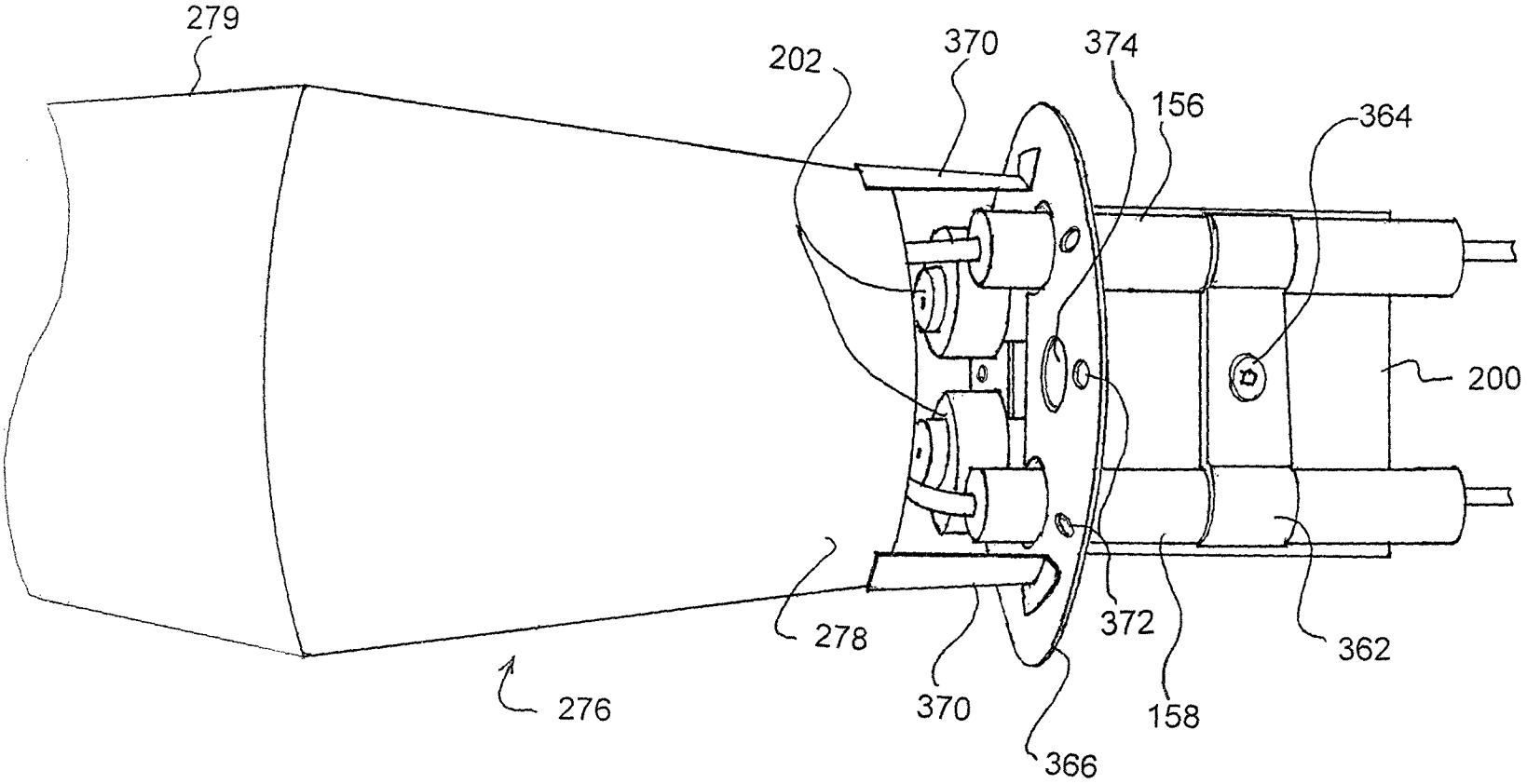
FIG. 12 is a diagrammatic top perspective view showing assembly of the opponents according to another embodiment of the present invention.
Figure 13:
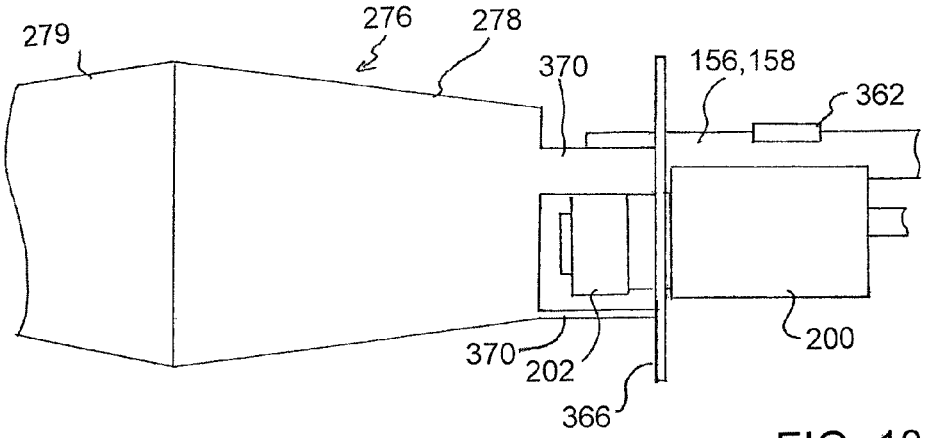
FIG. 13 is diagrammatic side elevational view of FIG. 12.
Figure 14:
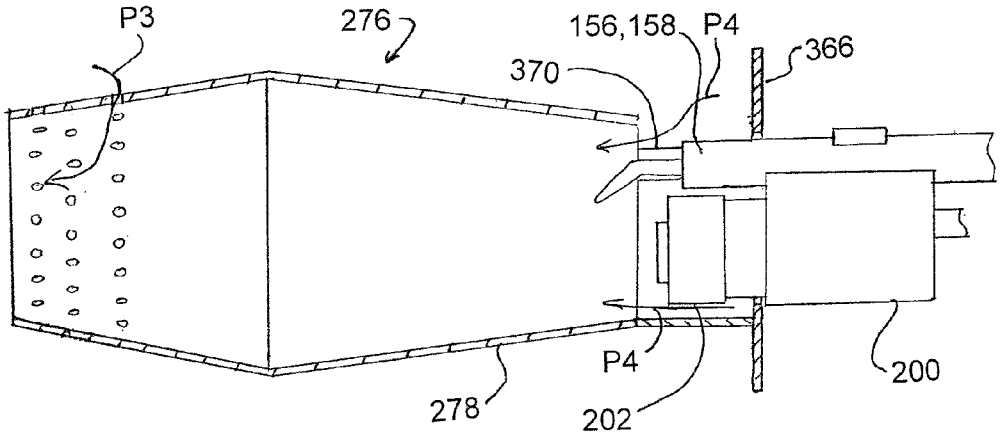
FIG. 14 is diagrammatic cross sectional view of FIG. 13.
Figure 15:
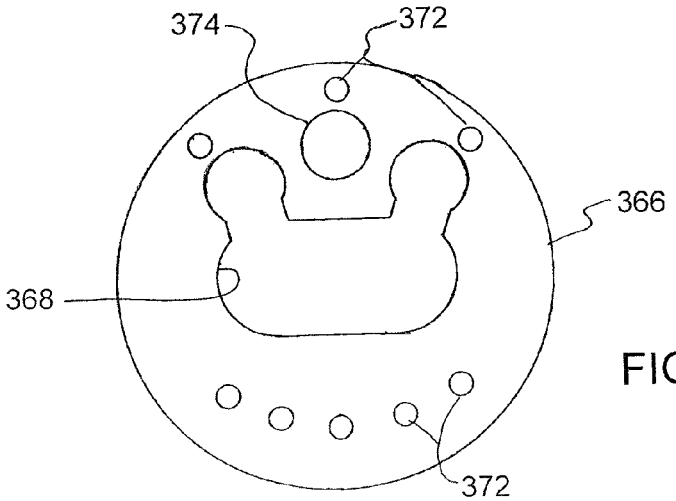
FIG. 15 is diagrammatic front elevational view of a circular air deflector disk according to the present invention.

As generally shown in FIGS. 12-14, an air deflector disk 366 separates and spaces the fuel discharge body or head 200 from the inlet of the air deflector sleeve 276. As shown in FIG. 15, the air deflector disk 366 is generally circular in shape and has a generally centrally located fuel discharge head passage 368 formed therein which is sized and shaped so as to closely accommodated and permit both of the discharge nozzles 202 and both of the electrodes (igniters) 156, 158 to pass therethrough while minimizing the amount of supplemental air which is permitted to also pass around the fuel discharge body or head 200 and flow into and though the fuel discharge head passage 368 of the air deflector sleeve 276. As shown, the leading surface of the fuel discharge body or head 200 is generally located closely adjacent, e.g., typically in abutting engagement, with a trailing surface of the circular air deflector disk 366, with both of the discharge nozzles 202 passing completely through the fuel discharge head passage 368. It is generally desirable that the spacing of the leading surface of the fuel discharge body or head 200 from the trailing surface of the circular air deflector disk 366 being fixed during operation, e.g., the leading surface of the fuel discharge body or head 200 may be directly abut against or be connected to the circular air deflector disk 366. Further, it is desirable that the spacing of the leading surface of the air deflector disk 366 from the inlet section 278 end of the air deflector sleeve 276 being fixed during operation, e.g., the leading surface of the air deflector disk 366 is directly connected to the air deflector sleeve 276 by a plurality of legs 370, e.g, three equally spaced legs having a length of between ¼ of an inch and about 1½ inches or so. As a result of such arrangement, the leading portions of both the discharge nozzles 202 and the electrodes (igniters) 156, 158 pass through the generally centrally located fuel discharge head passage 368 formed in the air deflector disk 366. The tips of the electrodes (igniters) 156, 158 are either located closely adjacent or extend partially into the inlet section 278 of the air deflector sleeve 276 while the discharge nozzles 202 are located in the space between the leading surface of the air deflector disk 366 and the inlet section 278 of the air deflector sleeve 276.

The air deflector disk 366 typically has a plurality of small supplemental air holes 372 formed therein, e.g., between 5 and 15 small holes, which permit only a minor or small portion of the supplied supplemental air to pass through air deflector disk 366 and into the inlet section 278 of the air deflector sleeve 276 while a remaining portion of the supplemental air is diverted by and around the air deflector disk 366, along the exterior surface of the air deflector sleeve 276, toward the flame retention head 266. Although the air deflector disk 366 is illustrated as having eight smaller air supplemental air holes 372 and one large hole 374 for the accommodating a flame detector (not shown), it is to be understood and appreciated that the air deflector disk 366 can be manufactured so as to have a greater or lesser amount and/or a different configuration of the supplemental air holes 372, i.e., the number, the positioning and the sizes of the supplemental air holes can vary depending on the desired air flow characteristics, paths or volume of the burner system.

Figure 16:
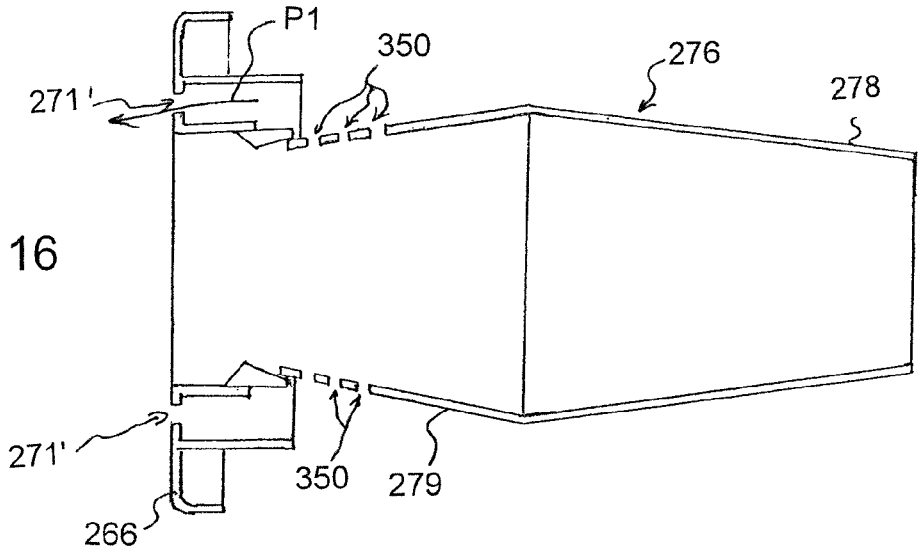
FIG. 16 is a diagrammatic cross-sectional view of the air deflector disk connected to the flame retention head.
Figure 17:
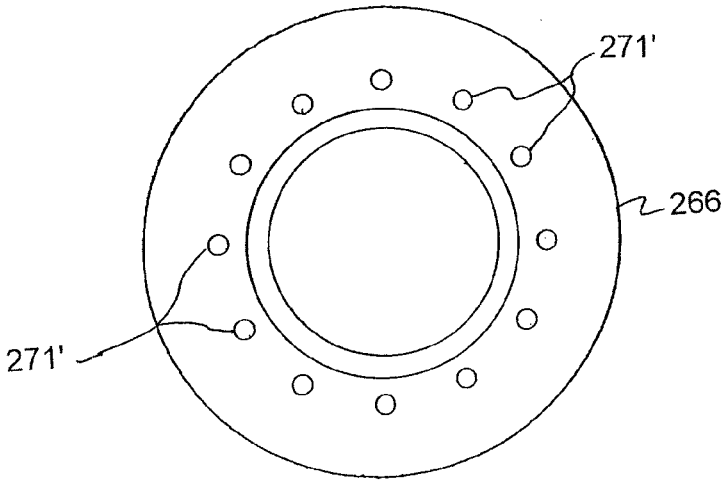
FIG. 17 is a diagrammatic front elevational view the flame retention head of FIG. 16.
Figure 18:
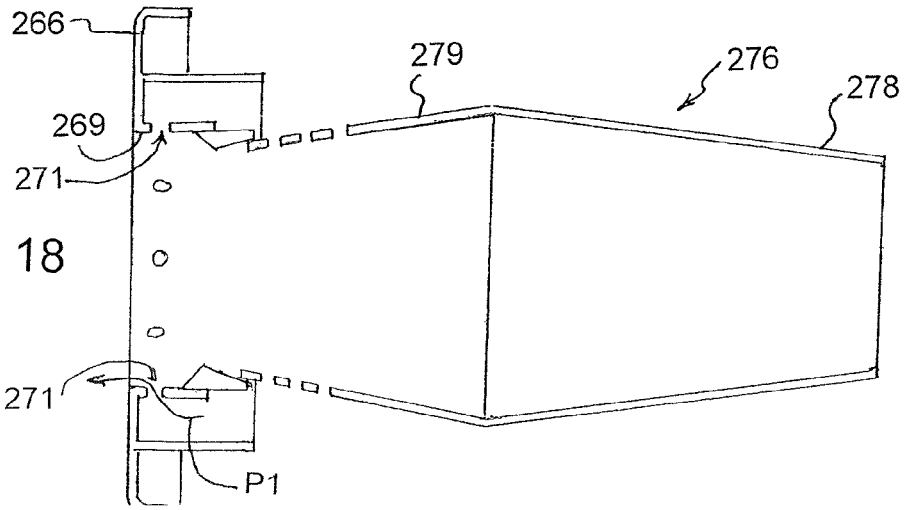
FIG. 18 is a diagrammatic cross-sectional view showing another embodiment of the air deflector disk connected to the flame retention head.

Turning now to FIGS. 16-18, further embodiment of the air deflector sleeve 276 will now be briefly discussed. As the embodiment of the air deflector sleeve 276 shown in these Figures are quite similar to the embodiment illustrated in 10A-10D, only the differences between these embodiments and those previously discussed above will be described. Turning first to FIGS. 16 and 17, the embodiment illustrated therein shows a plurality of apertures 271' being axially arranged in the annular retention head 166 such that a first, but limited, portion of the supplemental air is permitted to exit axially through the apertures 271', formed in the leading face of the flame retention head 266, and flow into the burner box. As best shown in the front view of the flame retention head 266 in FIG. 17, the plurality of apertures 271', e.g., 5 to 20 and preferably about 12 apertures 271', are generally located in a circular configuration and evenly spaced about the circumference of the passage air detention sleeve and have diameter of between about 1/16 of an inch and about ¼ of an inch, for example. The flame retention head 266 redirects the remaining portion of the supplemental air radially inward through the plurality of perforations, apertures or openings 350 in the outlet section 279 to assist with shaping the flame BF and complete combustion of the fuel mixture 153.

In contrast, the air deflector sleeve 276, shown in FIG. 18, is substantially identical to that shown in FIGS. 10A and 10B with the exception relating to the support and positioning of the fuel discharge head 200 and the fuel discharge body or head 200. The embodiment of FIG. 18 shows the cylindrical surface 269 comprising a plurality of apertures 271 that extend radially through the cylindrical surface 269 and are designed to direct a portion of the supplemental air radially inward, along a head flow path P1, instead of axially along the head flow path P1, as with FIGS. 16 and 17.

Figure 19:
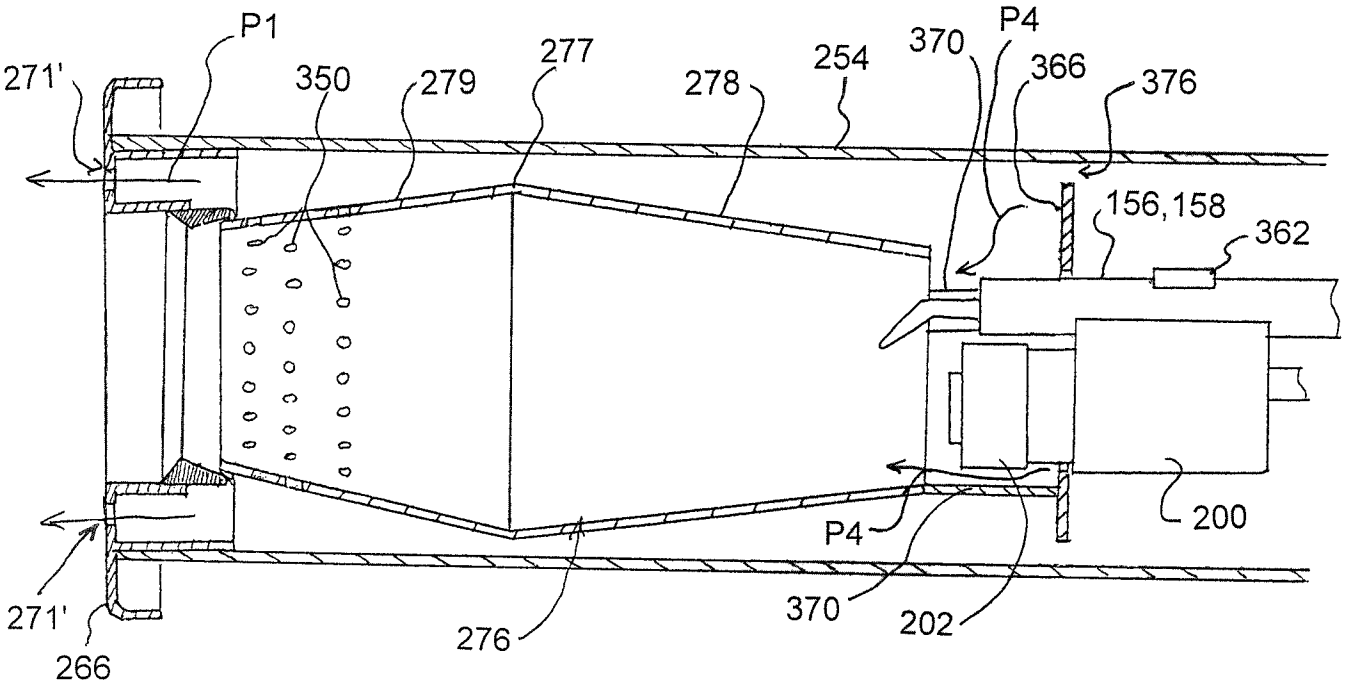
FIG. 19 is a diagrammatic cross-sectional view showing the assembly of the various components according to the present invention.

FIG. 19 illustrates the assembly of fuel discharge body or head 200, the discharge nozzles 202 and the electrodes (igniters) 156, 158, the air deflector disk 366, the air deflector sleeve 276 and the flame retention head 266 in combination with a cylindrical blast tube 254. As shown, both the air deflector disk 366 and the air deflector sleeve 276 are accommodated within the blast tube 254. The air deflector sleeve 276 and the air deflection disk 366 are supported within the blast tube 254 so as to be generally concentric located therein. The air deflection disk 366 has a slightly smaller diameter than the inside diameter of the blast tube 254 such that an annular gap 376 is formed between the exterior circumference of the air deflection disk 366 and the blast tube 254. The size of the annular gap 376 may vary, depending upon the particular application, but the dimensions are generally designed so as to permit a sufficient amount of the supplemental air, e.g., a majority of the supplement air, to flow around the air deflection disk 366 and toward the flame retention head 266.

An inlet section 278 of the air deflector sleeve 276 is axially spaced from the air deflection disk 366 by the spacer legs 370 such that the air deflection disk 366 and the fuel discharge head 200 are separated and spaced from the inlet section 278 of the air deflection sleeve 276. The spacer legs 370 allows a minor portion of the supplemental air, which flows around or through the air deflection disk 366, to flow into the inlet section 278 of the air deflector sleeve 276, along a deflector sleeve flow path P4, to assist with complete combustion of the fuel mixture 153.

Preferably a speed of the fan or the blower is adjustable in order to regulate the velocity (and the volume) of the supplemental air being forced or directed to flow through the cylindrical blast tube 254, e.g., at a flow rate of between 5 feet per second to about 100 feet per second or so, for example. The air deflector sleeve 276 assists with combustion of the fuel mixture 153 as the fuel mixture 153 flows axially along a longitudinal axis of the fuel combustion system 2 and the supplemental air prevents the cylindrical blast tube 254 from becoming excessively hot during the combustion process.

The supplemental air that does not flow into the inlet section 278, and through the air deflector sleeve 276, is redirected and diverted by the air deflector disk 366 and the air deflector sleeve 276 so as to flow axially toward the flame retention head 266 along the space located between the inwardly facing surface of the blast tube 254 and the exterior surface of the air deflector sleeve 276. The outlet section 279 of the air deflector sleeve 276, according to this embodiment and like the previously described embodiment, includes a plurality of spaced apart apertures 350, e.g., the outlet section 279 generally comprises a perforated surface which has a plurality of equally spaced perforations, apertures or openings 350 formed therein, e.g., between 15 and 100 or so perforations, apertures or openings 350 and more preferably about 45 generally equally spaced perforations, apertures or openings 350. Each one of the perforation, aperture or opening 350 is approximately a ⅛ inch in diameter±¼ of inch and extends completely through the surface of the outlet section 279. The perforations, apertures or openings 350, formed in the outlet section 279, form an outlet section flow path P3 for the supplemental air which further assists with shaping and complete combustion of the fuel mixture 153.

It will be appreciated to those skilled in the art that the perforations, apertures or openings 350 may be arranged, if desired, to impart a desired swirling motion (either in a first rotational direction or in an opposite rotational direction) to the supplemental air flowing therethrough to further assist with shaping and complete combustion of the fuel mixture 153 as well as slowing the combustion components flowing through the air deflector sleeve 276. It will also be appreciated, however, that the number, the size, the shape, the spacing, and the location of these plurality of perforations, apertures or openings 350 can vary, from application to application, depending upon the particular requirements of the fuel combustion system.

The plurality of apertures 271', arranged in the end face of the annular retention head 266, direct a first portion of the supplemental air to flow directly axially through the end face of the flame retention head 266 and form another air head flow path P1. As a result of the above, the supplied supplemental air is directed and diverted along one of three possible flow paths P1, P3 or P4. The head flow path P1 is through the plurality of apertures 271' in the end face of the annular retention head 266. The outlet section flow path P3 is through the plurality of holes 350 formed within the outlet section 279 of the air deflector sleeve 276. The deflector sleeve flow path P4 is generally through or around the air deflector disk 366 and into the inlet section 278 of the air deflector sleeve 276.

Turning now to FIGS. 20-23, another embodiment of the present invention will now be described in detail while identical elements will be given identical reference numerals. The major differences between this embodiment in the embodiment of FIGS. 12-19 and the embodiment of FIGS. 20-23 are: 1) a cylindrical sleeve 380 is provided which surrounds the space located between the leading surface of the air deflection disk 366 and the inlet section 278 of the air deflector sleeve 276 and fixedly connects those two components with one another, 2) both of the discharge nozzles 202, instead of the fuel discharge body or head 200, abut against the rear surface of the air deflection disk 366 instead of passing through the fuel discharge head passage 368 formed in the air deflector disk 366, and 3) both the cylindrical sleeve 380 and the inlet section 278 of the air deflector sleeve 276 are provided with a plurality of small supplemental air apertures 382, 384 formed therein, 1/16 to 1/4 of an inch, for supplying supplemental air radially inward to assist with combustion of the fuel mixture 153 and maintaining the cylindrical sleeve 380 and the air deflector sleeve 276 at a relatively cool temperature during operation.

As generally illustrated, the fuel discharge head 200 supports a pair of spaced apart discharge nozzles 202 which is connected to be supplied with liquid fuel and pressurized air and discharge the fuel mixture 153, as described above. In addition, a pair of conventional electrodes (igniters) 156, 158, which facilitate ignition of the discharged fuel mixture 153, are supported by the exterior surface of the fuel discharge body or head 200. Each electrode (igniter) 156, 158 has an ignition tip located adjacent the outlet of a respective one of the discharge nozzles 202 for igniting the discharged fuel mixture 153. The electrodes (igniters) 156, 158 are fixed to the fuel discharge body or head 200 via an electrode retainer 362. Each opposite end of the electrode retainer 362 is slightly curved so as to follow and closely conform to the exterior contour and maximize contact with the cylindrically shaped body of the electrodes (igniters) 156, 158. A center portion of the electrode retainer 362 is secured to the fuel discharge body or head 200 by a conventional bolt or screw that passes through a hole in the electrode retainer 362 and mates with a corresponding threaded aperture formed in the fuel discharge body or head 200 for securing the electrodes (igniters) 156, 158 to the fuel discharge body or head 200.

Figure 22:
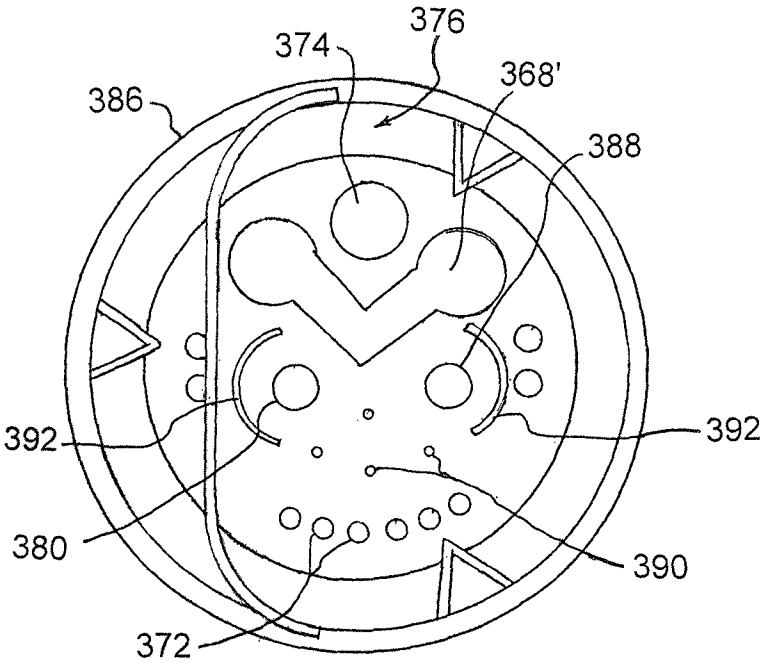
FIG. 22 is diagrammatic front elevational view of the circular air deflector disk of FIG. 20.
Figure 23:
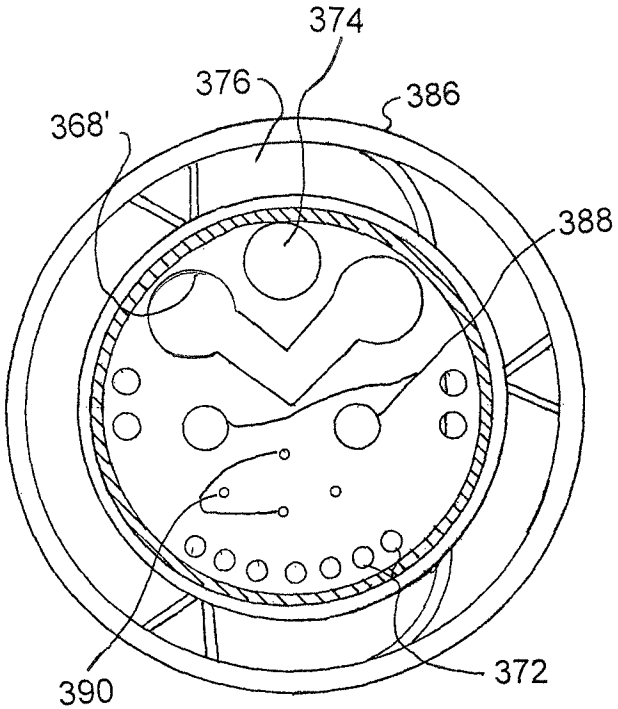
FIG. 23 is diagrammatic rear elevational view of the circular air deflector disk of FIG. 20.

As shown in FIGS. 22 and 23, the air deflector disk 366 is generally circular in shape and is supported by an annular ring 386 which has a diameter which is slightly smaller than an internal diameter of the cylindrical blast tube 254 so as to facilitate sliding movement of the annular ring 386 and the air deflector disk 366 with respect to the blast tube 254 as well as centering of the air deflector disk 366 within the blast tube 254. An annular gap 376 is formed between the annular ring 386 and the circumferential edge of the air deflector disk 366 which permits flow of the supplemental air therethrough toward the annular retention head 266. The air deflector disk 366 has a generally centrally located, but smaller electrode passage 368 formed therein which is sized and shaped so as to closely accommodated and generally only permit the pair of electrodes (igniters) 156, 158 to pass through the passage while also control/minimize the amount of the supplemental air which is permitted to flow into and though the electrode passage 368 and into the air deflector sleeve 276.

The air deflector disk 366 is provided with a pair of spaced apart nozzle apertures 388 which are each larger than the discharge orifices of the discharge nozzles 202 and arranged so as to permit the fuel mixture 153, which is discharged from each one of the respective discharge nozzles 202, to pass through the nozzle apertures 388 of the air deflector disc 366 and flow into the cylindrical sleeve 380 and the air deflector sleeve 276, while preventing the discharge nozzles 202 from passing through the nozzle apertures 388.

A plurality of small supplemental air apertures 390, e.g., four apertures, are centrally located in the air deflector disc 366 between the pair of spaced apart nozzles. These small centrally located supplemental air apertures permit a small quantity of the supplemental air to pass therethrough and facilitate cooling of the discharge nozzles 202 as well as facilitate complete combustion of the discharged fuel mixture 153. In addition, a pair of alignment members 392 are provided to assist supporting each one of the discharge nozzles 202 and centering the same with a respective one of the nozzle apertures 388 and ensure that the discharged fuel mixture flows through the nozzle apertures 388 and into the air deflector sleeve 276.

As noted above, the cylindrical sleeve 380 completely surrounds the space located between leading surface of the air deflection disk 366 and the inlet section 278 of the air deflector sleeve 276. The cylindrical sleeve 380 typically has an axial length of about 1¼ inches or so and an inside diameter of about 2¼ inches or so. The cylindrical sleeve 380 fixedly connects, e.g., by welding, the leading surface of the air deflection disk 366 with the inlet section 278 of the air deflector sleeve 276 so that those components are integral with one another. As a result of connection, the air deflection disk 366, the cylindrical sleeve 380, and the inlet and the outlet sections 278, 279 of the air deflector sleeve 276 combine to form a combustion chamber 394 which extends from the leading surface of the air deflection disk 366 to the outlet section 279 which communicates with the burner box, following installation. The combustion chamber 394 typically has an axial length of about 5 to 8 inches or so, typically about 6½ inches or so.

The air deflector disk 366 also has a plurality of small supplemental air holes 372 formed therein, e.g., between 5 and 15 small holes, which permit only a minor or small portion of the supplied supplemental air to pass through air deflector disk 366 and into the combustion chamber 394 while a remaining portion of the supplemental air flows along the exterior surface of the air deflector sleeve 276, inside the blast tube 254 toward the flame retention head 266. Although the air deflector disk 366 is illustrated as having 10 smaller supplemental air holes 372 and one larger air hole 374, which accommodates a flame detector (not shown in these figures), it is to be understood and appreciated that the air deflector disk 366 can be manufactured so as to have a greater or lesser amount and/or a different configuration of the supplemental air holes 372, i.e., the number, the positioning and the sizes of the air holes can vary depending on the desired air flow characteristics, paths and/or volume of air to flow into the combustion chamber 394.

As shown in FIG. 21, the leading surfaces of the discharge nozzles 202 are generally located in abutting engagement with a trailing surface of the circular air deflector disk 366 such that each one of the discharge nozzles 202 is aligned with a respective one of the nozzle apertures 388 for discharging the fuel mixture 153 directly into the combustion chamber 394 while the tips of both of the electrodes (igniters) 156, 158 pass through the electrodes passage 368' and are located within the combustion chamber 394. It is desirable that the longitudinal axis of the fuel discharge body or head 200 and the longitudinal axis of the combustion chamber 394 are substantially aligned and coincident with one another and both axes extend substantially perpendicular to the air deflector disk 366. This arrangement ensures that the fuel mixture 153 is supplied generally along the longitudinal axis L of the combustion chamber 394 and blast tube 254 which thereby assists with facilitating complete combustion of the fuel mixture 153.

As with the previous embodiment illustrated in FIGS. 16 and 17, a plurality of apertures 271 are arranged in the annular retention head 266 such that some of the supplemental air is permitted to exit axially through the apertures 271', formed in the leading face of the flame retention head 266, and flow axially into the burner box and surround and encase the flame BF as it enters into the burner box.

Figure 20:
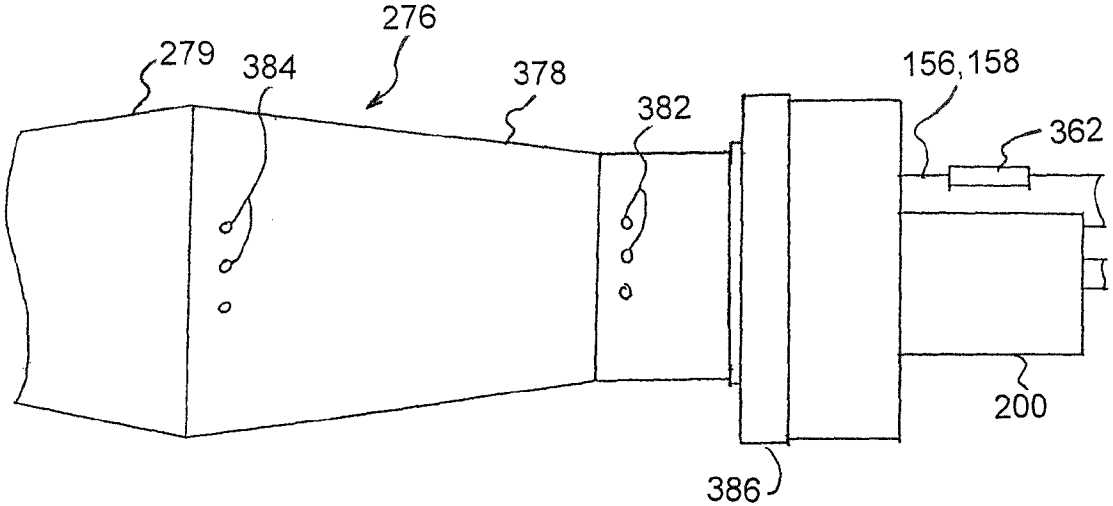
FIG. 20 is a diagrammatic side elevational view showing assembly of the opponents according to a still further embodiment of the present invention.

FIGS. 20 and 21 both illustrates an assembly of the discharge nozzles 202 and electrodes (igniters) 156, 158, the air deflection disk 366 and the air deflector sleeve 276 with one another, while the flame retention head 266 and the cylindrical blast tube 254 are omitted for reasons of simplicity. According to this embodiment, the air deflector sleeve 276 and the air deflection disk 366 are fixed within the blast tube 254 so as to be generally concentric located therein. As noted above, both the cylindrical sleeve 380 and the inlet section 278 have a plurality of apertures formed therein 382, 384 for supplying some supplemental air, radially inwardly, into the combustion chamber 394 along sleeve and inlet section flow paths P5, P6, respectively. The cylindrical sleeve 380 preferably has between 3 and 15 apertures 382 formed therein, typically about 7 apertures which have a diameter of 1/16 or 1/4 of an inch or so, for permitting air to flow through the cylindrical sleeve 380 and into the combustion chamber 394. The inlet section 278 preferably has between 5 and 20 apertures 384 formed therein, typically about 11 apertures which have a diameter of 1/16 or 1/4 of an inch or so, for permitting air to flow through the cylindrical sleeve 380 and into the combustion chamber 394. The apertures 384 formed in the inlet section 278 are typically located adjacent a mid-section 277 of the air deflector sleeve 276.

Preferably a speed of the fan or the blower is adjustable in order to regulate the velocity (and the volume) of the supplemental air being forced or directed to flow through the cylindrical blast tube 254, e.g., at a flow rate of between 5 feet per second to about 100 feet per second or so, for example. The supplemental air that does not flow through the air deflector disk 366 and into the combustion chamber 394 is diverted by the air deflector disk 366 and flows along the exterior surface of the air deflector sleeve 276, in the space between the inwardly facing surface of the blast tube 254 and the exterior surface of the air deflector sleeve 276, toward the flame retention head 266. The outlet section 279 of the air deflector sleeve 276 includes a plurality of spaced apart apertures 350, e.g., the outlet section 279 generally comprises a perforated surface which has a plurality of equally spaced perforations, apertures or openings 350 formed therein, e.g., between 15 and 100 or so perforations, apertures or openings 350, and more preferably about 30 generally equally spaced perforations, apertures or openings 350 in the embodiment shown in FIGS. 20-23. Each one of the perforation, aperture or opening 350 is approximately a 1/8 inch in diameter±1/4 of inch and extends completely through the surface of the outlet section 279. The perforations, apertures or openings 350, formed in the outlet section 279, form an outlet section flow path P3 for the supplemental air which further assists with shaping and complete combustion of the fuel mixture 153 and also cooling the outlet section 279 of the air deflector sleeve 276.

It will be appreciated to those skilled in the art that the perforations, apertures or openings 350 may be arranged, if desired, to impart a desired swirling motion (either in a first direction or in an opposite direction) to the supplemental air flowing therethrough to further assist with cooling, shaping and/or facilitating complete combustion of the fuel mixture 153. It will also be appreciated, however, that the number, the size, the shape, the spacing, and the location of these plurality of perforations, apertures or openings 350 can vary, from application to application, depending upon the particular requirements of the fuel combustion system.

The plurality of apertures 271', arranged in the end face of the annular retention head 266, direct a first portion of the supplemental air to flow directly axially through the end face of the flame retention head 266 and form a head flow path P1. The supplemental air, flowing along the head flow path P1, generally surrounds and encases the combusted fuel mixture 153 (i.e., the flame BF) and impacts against an opposed surface of the burner box and generally forms an air buffer which generally prevents the flame BF from contacting the opposed surface of the burner box. As a result of the above, the supplied supplemental air is directed and diverted along one of five possible flow paths P1, P3, P4, P5 or P6. The head flow path P1 is through the plurality of apertures 271' in the end face of the annular retention head 266. The outlet section flow path P3 is through the plurality of holes 350 formed within the outlet section 279 of the air deflector sleeve 276. The deflector sleeve flow path P4 is generally through or around the air deflector disk 366 and into the combustion chamber 394. The sleeve flow path P5 is through the plurality of apertures 382 formed in the cylindrical sleeve 380 and into the combustion chamber 394. The inlet section flow path P6 is through the plurality of apertures 384 formed in the inlet section 278 of the air deflector sleeve 276 and into the combustion chamber 394.

The present invention is directed at minimizing the flow of liquid fuel used to supplied to the combustion chamber 394. Typically, between a ½ and 16 gallons per hour liquid fuel is utilized during normal operation, e.g., depending upon the size of the boiler. As the fuel mixture 153 enters into the combustion chamber 394, the supplemental air, supplied along the flow path P3, P4, P5 and P6, assists with complete combustion of the fuel mixture 153 as well as maintaining the flame BF substantially centered within the combustion chamber 394 and spaced from the air deflector sleeve 276. The supplemental air, supplied via the outlet section flow path P3 of the air deflector sleeve 276, has a tendency of slowing the combustion components, as they flow towards the burner box, and thereby further assist with complete combustion and shaping of the flame BF.

As discussed briefly above, the blast tube 254 typically has an outer diameter of between about 2.5 to about 8 inches, more preferably an outer diameter of about 4±1 inches. It would, however, be advantageous and desirable for all of the blast tubes 254 to be manufactured so as to have a common diameter and thereby reduce the associated costs of producing various sized blast tubes. However, it is recognized that due to the number of manufacturers and models of fuel combustion systems currently available in the market, the sizes of the system mounts for the blast tubes 254 of the different systems can often vary from one another manufacture to another to a greater extent. Specifically the diameters of the system mounts 476 for the blast tubes 254 can vary from between about 2.5 to about 8 inches.

In order to facilitate modification of the those existing heating or boiler systems with the improved burner system according to the present invention, the present invention also relates to an adaptor 396 which facilitates coupling of the components of the present invention to the existing system mounts. In order to easily, inexpensively and quickly facilitate coupling of the components of the present invention with the system mounts 398 of the existing heating or boiler system, typically a suitably tapered adaptor 396 is utilized.

Figure 24:
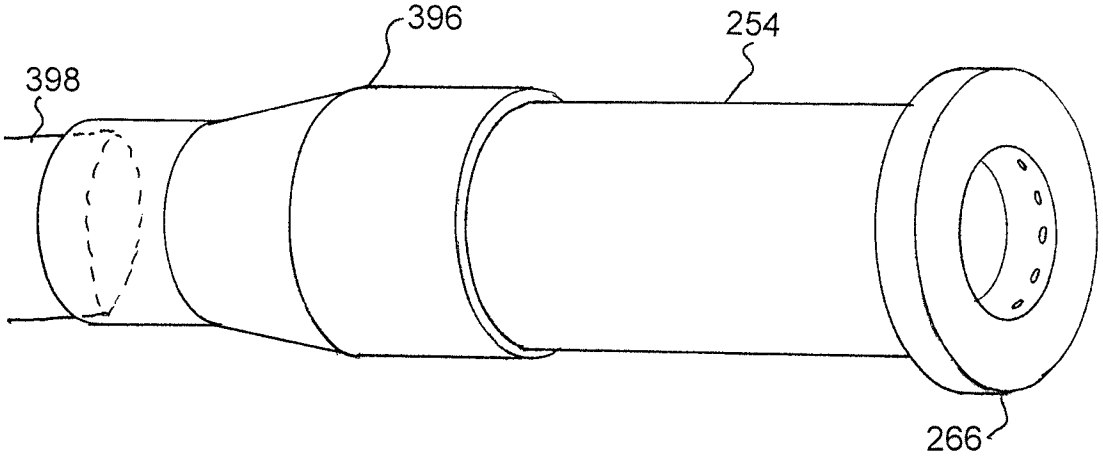
FIG. 24 is a diagrammatic perspective view showing an adapter for facilitating coupling of the blast tube and the other components of the present invention to a smaller system mount of installed equipment.
Figure 25:
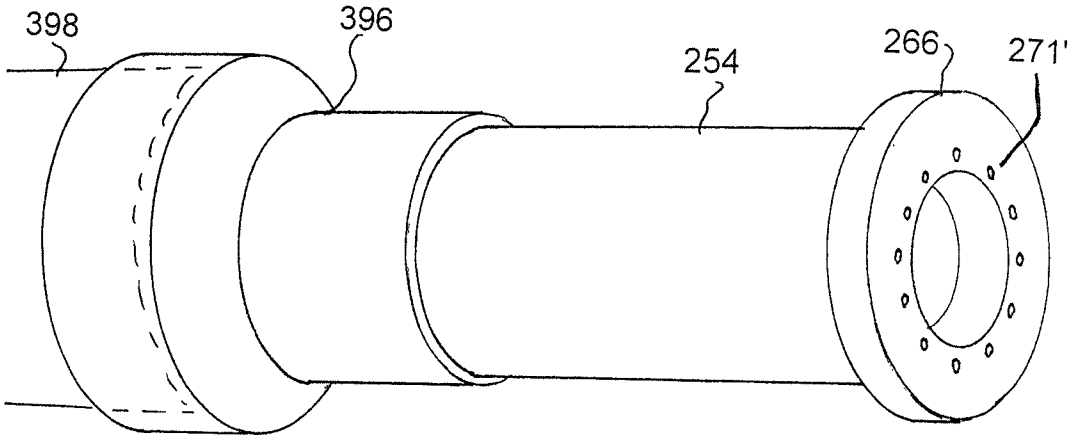
FIG. 25 is a diagrammatic perspective view showing an adapter for facilitating coupling of the blast tube and the other components of the present invention to a larger system mount of installed equipment.

For example, as illustrated in FIG. 24, in the event that the existing heating or boiler system has an existing relatively smaller system mount 398 for the blast tube 254, e.g., having a diameter of about 3 inches for example, a tapered increasing adapter 396 is utilized so as to facilitate coupling of the blast tube 254 and the other components of the present invention to the smaller system mount 398. On the other hand, as illustrated in FIG. 25, in the event that the existing heating or boiler system has an existing relatively large system mount 398 for the blast tube 254, e.g., having a diameter of about 6½ inches for example, a tapered decreasing adapter 396 is utilized so as to facilitate coupling of the blast tube 254 and the other components of the present invention to the larger system mount 398.

The present invention typically results in substantially complete combustion of the fuel mixture 153 so that less than 300 ppm of carbon monoxide (CO) remain, more preferably less than 300 ppm of carbon monoxide (CO) remain, and most preferably about 20 ppm or less, (e.g. 3 to 4 ppm) of carbon monoxide (CO) remain in the exhaust gases. In addition, preferably a one-way valve or a liquid fuel solenoid valve (not shown) is located along the liquid fuel supply line. This one-way valve or liquid fuel solenoid valve typically automatically opens when liquid fuel is being supplied to the discharge nozzles 202, but the one-way valve or a liquid fuel solenoid valve immediately and automatically closes when the supply of liquid fuel is interrupted. The one-way valve or a liquid fuel solenoid valve assist with minimizing the amount of liquid fuel which is permitted to drip from the discharge nozzles 202 when the system is not operating or is inactive.

Since certain changes may be made in the above described improved fuel combustion system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A fuel combustion system for burning a fuel mixture, the fuel combustion system comprising:

at least one discharge nozzle being supported by a fuel discharge body, and each at least one discharge nozzle having a liquid fuel orifice and a concentric air orifice surrounding the liquid fuel orifice;

a liquid fuel supply conduit being coupled to each liquid fuel orifice supplying liquid fuel thereto from a fuel supply;

an air supply conduit being coupled to each air orifice for supplying pressurized air thereto from a pressurized air source;

the liquid fuel and the pressurized air only mixing with one another, to form the fuel mixture, upon being discharged from the concentric liquid fuel and air orifices;

an inlet section of an air deflector sleeve being located for receiving the fuel mixture discharged by the at least one discharge nozzle;

a blast tube surrounding the air deflector sleeve and an outlet end of the cylindrical blast tube supporting a flame retention head;

a supplemental air fan for supplying supplement air into an inlet end of the blast tube to assist with combustion of the fuel mixture;

an air deflector being located between the fuel discharge body and an inlet end of the air deflector sleeve for directing some of the supplement air to flow into the inlet section of the air deflector sleeve and redirecting a remaining portion of the supplement air toward the flame retention head; and the flame retention head discharging some of the supplemental air axially through plurality of plurality of apertures formed therein and redirecting a remaining portion of the supplement air radially inward through a plurality of openings formed in an outlet section of the air deflector sleeve to assist with combustion of the fuel mixture.

2. The fuel combustion system according to claim 1, wherein the at least one discharge nozzle comprises a pair of discharge nozzles and the fuel combustion system further comprises a pair of electrodes, located adjacent and downstream of the pair of discharge nozzles, for igniting the fuel mixture following discharged thereof from the pair of discharge nozzles, and a flame detector is located adjacent the pair of discharge nozzles for detecting a presence of a flame generated by combustion of the fuel mixture.

3. The fuel combustion system according to claim 1, wherein a cylindrical sleeve couples the air deflector to the inlet section of the air deflector sleeve, and the air deflector, the cylindrical sleeve, and the inlet and the outlet sections of the air deflector sleeve form a combustion chamber for communicating with a burner box, following installation of the fuel combustion system.

4. The fuel combustion system according to claim 1, wherein the air deflector has an annular ring which has a diameter which is less than an internal diameter of the blast tube, the air deflector has an electrode passage which is sized and shaped to permit a pair of electrodes, supported by the fuel discharge body, to pass therethrough, and the air deflector has a plurality of small supplemental air holes which permit a minor portion of the supplemental air to pass through air deflector and flow into a combustion chamber while a remaining portion of the supplemental air is diverted by the air deflector.

5. The fuel combustion system according to claim 1, wherein the air deflector is a disk has a pair of spaced apart nozzle apertures which are each larger than the liquid fuel and the air discharge orifices of the discharge nozzles so as to permit the fuel mixture, which is discharged from each one of the respective discharge nozzles, to flow through the nozzle apertures of the air deflector and into a combustion chamber while preventing the discharge nozzles from extending into the combustion chamber.

6. The fuel combustion system according to claim 1, wherein a plurality of small supplemental air apertures are formed in both the cylindrical sleeve and the inlet section of the air deflector sleeve for supplying supplemental air radially inward to assist with combustion of the fuel mixture.

7. The fuel combustion system according to claim 1, wherein the inlet section of the air deflector sleeve is axially spaced from the air deflector by at least one spacer leg so that the air deflector is spaced from the inlet section of the air deflection sleeve, and the at least one spacer leg allows a minor portion of the supplemental air, which flows around or through the air deflector, to flow into the inlet section of air deflector sleeve and assist with complete combustion of the fuel mixture.

8. The fuel combustion system according to claim 1, wherein the outlet section has between 15 and 100 apertures formed therein, and each one of the apertures is approximately a ¼±-⅛ of an inch in diameter and a mid-section of the air deflector sleeve has a diameter of between 2 and 6 inches, and a diameter of the mid-section of the air deflector sleeve is between 15-50% greater than a diameter of both of the inlet end and an outlet end of the air deflector sleeve.

9. The fuel combustion system according to claim 1, wherein opposed ends of the inlet and the outlet sections of the air deflector sleeve are both open and a diameter of open ends of the inlet and the outlet sections is less than a diameter of a mid-section of the air deflector sleeve.

10. The fuel combustion system according to claim 1, wherein each liquid fuel orifice is centrally located within the pressurized air orifice and projects through a cover of the discharge nozzle by a distance of at least 0.002 of an inch more than the air orifice so that the liquid fuel only mixes with the pressurized air upon being discharged.

11. The fuel combustion system according to claim 1, wherein the liquid fuel supply conduit is connected to a liquid fuel storage tank which stores a supply of the liquid fuel, and the liquid fuel is supplied from the liquid fuel storage tank to the at least one discharge nozzle at a pressure of between about 0.5 psi and about 2 psi.

12. The fuel combustion system according to claim 11, wherein at least one valve is provided along the liquid fuel supply conduit for interrupting a flow of the liquid fuel from the liquid fuel storage tank to the at least one discharge nozzle, when the fuel combustion system is inactive, and a liquid fuel pump is provided for pumping the liquid fuel from the liquid fuel storage tank to the at least one discharge nozzle.

13. The fuel combustion system according to claim 12, wherein the liquid fuel pump pumps the liquid fuel from the liquid fuel storage tank along the liquid fuel supply conduit at a flow rate of between about 1 gallon per hour to about 16 gallons per hour and at a pressure of between about 70 psi to about 300 psi, and the liquid fuel supply conduit has a fuel regulator for reducing a pressure of the supplied liquid fuel to a pressure of between 0.5 psi and 2 psi.

14. The fuel combustion system according to claim 1, wherein the pressurized air source comprises an air compressor which supplies compressed air along a pressurized air supply conduit to each air orifice at a pressurize of between 2 and 30 psi.

15. The fuel combustion system according to claim 14, wherein the pressurized air supply conduit contains an air restrictor therein for reducing the pressure of the pressurized air being supplied by the air compressor, and the air restrictor reduces the pressure of the pressurized air to an air pressure of between 3.5 psi and 7.0 psi.

16. The fuel combustion system according to claim 1, wherein a pressurized air solenoid valve is located along the pressurized air supply conduit for interrupting a flow of the pressurized air to the at least one discharge nozzle when the combustion system is inactive, and a liquid fuel solenoid valve is located along the liquid fuel supply conduit for interrupting a flow of the liquid fuel to the at least one discharge nozzle when the fuel combustion system is inactive.

17. A fuel combustion system for burning a fuel mixture, the fuel combustion system comprising:

a pair of discharge nozzles being supported by a fuel discharge body, and each discharge nozzle having a centrally located liquid fuel orifice and a concentric air orifice surrounding the liquid fuel orifice;

a liquid fuel supply conduit being coupled to each liquid fuel orifice for supplying liquid fuel thereto from a fuel supply;

an air supply conduit being coupled to each air orifice for supplying pressurized air thereto from a pressurized air source;

the liquid fuel and the pressurized air only mixing with one another, to form the fuel mixture, upon being discharged from the concentric liquid fuel and air orifices;

an air deflector disk;

an air deflector sleeve having both an inlet section and an outlet section;

the air deflection disk being located between the fuel discharge body and an inlet end and the air deflection disk, and the inlet and the outlet sections of the air deflector sleeve forming a combustion chamber for communicate with a burner box;

the pair of discharge nozzles both discharging the fuel mixture through the air deflector disk into the combustion chamber;

a cylindrical blast tube surrounding the air deflector sleeve and an outlet end of the cylindrical blast tube supporting a flame retention head;

a supplemental air fan for supplying supplement air into an inlet end of the blast tube for supplying supplement air to assist with combustion of the fuel mixture;

the air deflector disk directing some of the supplement air into the combustion chamber and redirecting a remaining portion of the supplement air toward the flame retention head; and the flame retention head discharging some of the supplemental air axially through plurality of plurality of apertures formed therein and redirecting a remaining portion of the supplement air radially inward through a plurality of openings formed in an outlet section of the air deflector sleeve to assist with combustion of the fuel mixture;

a pair of electrodes, being located adjacent the pair of discharge nozzles, for igniting the fuel mixture following discharged thereof from the pair of discharge nozzles; and a flame detector being located adjacent the pair of discharge nozzles for detecting a presence of a flame generated by combustion of the fuel mixture.

18. The fuel combustion system according to claim 17, wherein the air deflector disk has an electrode passage which is sized and shaped to permit the pair of electrodes to pass therethrough and extend into the combustion chamber; and the air deflector disk has a plurality of small supplemental air holes which permit a minor portion of the supplemental air to pass through air deflector disk and flow into the combustion chamber while a remaining portion of the supplemental air is diverted by the air deflector disk toward the outlet end of the cylindrical blast tube.

19. The fuel combustion system according to claim 18, wherein the air deflector disk has a pair of spaced apart nozzle apertures which are each larger than the liquid fuel and the air discharge orifices of the pair of discharge nozzles so as to permit the discharged fuel mixture to flow through the nozzle apertures of the air deflector disk and into the combustion chamber while preventing the discharge nozzles from extending into the combustion chamber; and a plurality of small supplemental air apertures are formed in both the cylindrical sleeve and the inlet section of the air deflector sleeve for supplying supplemental air radially inward to assist with combustion of the fuel mixture.

20. A method of supplying a fuel mixture to a fuel combustion system for burning the fuel mixture, the fuel combustion system comprises at least one discharge nozzle supported by a fuel discharge body, and each discharge nozzle has a centrally located liquid fuel orifice and a concentric air orifice surrounding the liquid fuel orifice; a liquid fuel supply conduit coupled to each liquid fuel orifice for supplying liquid fuel thereto from a fuel supply; an air supply conduit being coupled to each air orifice for supplying pressurized air thereto from a pressurized air source; the liquid fuel and the pressurized air only mixing with one another, to form the fuel mixture, upon discharge from the respective liquid fuel and air orifices; an inlet section of an air deflector sleeve is axially spaced from the at least one discharge nozzle for receiving the fuel mixture discharged by the at least one discharge nozzle; a cylindrical blast tube surrounds the air deflector sleeve and an outlet end of the cylindrical blast tube supports a flame retention head; a supplemental air fan supplies supplement air into an inlet end of the blast tube for supplying supplement air to assist with combustion; an air deflector being located between the fuel discharge body and the inlet section of the air deflector sleeve for directing some of the supplement air to flow into the inlet section of the air deflector sleeve and redirecting a remaining portion of the supplement air toward the flame retention head; the method comprising the step of:

permitting a minor portion of the supplement air to flow through openings in the air deflector and into the combustion chamber while redirecting a remaining portion of the supplement air toward the flame retention head; and directing some of the supplemental air, via the flame retention head, axially through apertures in the flame retention head into a burner box, and redirecting a remaining portion of the supplemental air through a plurality of apertures formed in the outlet section of the air deflector sleeve to assist with combustion of the fuel mixture.

* * * * *